US011959239B1

(12) United States Patent
Shear

(10) Patent No.: US 11,959,239 B1
(45) Date of Patent: Apr. 16, 2024

(54) MECHANIZED BOAT DOCK

(71) Applicant: David Shear, Ann Arbor, MI (US)

(72) Inventor: David Shear, Ann Arbor, MI (US)

( * ) Notice: Subject to any disclaimer, the term of this patent is extended or adjusted under 35 U.S.C. 154(b) by 0 days.

(21) Appl. No.: 18/370,956

(22) Filed: Sep. 21, 2023

(51) Int. Cl.
*E02B 3/24* (2006.01)
*B63B 21/00* (2006.01)

(52) U.S. Cl.
CPC ..... *E02B 3/24* (2013.01); *B63B 21/00* (2013.01)

(58) Field of Classification Search
CPC ... E02B 3/00; E02B 3/24; B63B 21/00; B63B 21/04; B63B 21/18; B63B 21/20; B63B 21/54
USPC ..... 114/230.1
See application file for complete search history.

(56) References Cited

U.S. PATENT DOCUMENTS 2,771,053 A 11/1956 Gustafson
3,151,595 A 10/1964 Stainbrook
3,157,150 A 11/1964 Faber, Jr.
3,280,784 A * 10/1966 Stainbrook ..... B63B 21/54 114/230.25
4,143,613 A * 3/1979 Paul ..... E02B 3/20 114/230.25
4,462,329 A 7/1984 Brushaber
5,603,280 A 2/1997 Shackelford, Jr.
5,787,834 A * 8/1998 Holland ..... B63B 21/54 114/230.26
6,123,045 A * 9/2000 Prongay ..... E02B 3/20 114/230.15
8,567,334 B1 10/2013 Matlin et al.
8,763,550 B1 7/2014 Matlin et al.
2009/0320735 A1 12/2009 Jimenez Del Amo

FOREIGN PATENT DOCUMENTS

WO 2009048342 A2 4/2009

* cited by examiner

*Primary Examiner* — Lars A Olson
(74) *Attorney, Agent, or Firm* — Howard & Howard Attorneys PLLC

(57) ABSTRACT

A system for providing a line to a boat is provided. The system includes the line attached to a portion of a dock and a line tending unit configured for selectively operating in a stowed state and in a deployed state. The line tending unit includes a line tending arm including an attachment end configured for releasably holding the line and a line tending unit actuator configured to actuate the line tending arm between a stowed condition corresponding to the stowed state and a deployed condition corresponding to the deployed condition. The system further includes a control device in communication with the line tending unit and configured for commanding the line tending unit between the stowed state and the deployed state.

15 Claims, 18 Drawing Sheets

MECHANIZED BOAT DOCK

BACKGROUND

A boat dock may be configured for mooring a boat or a ship. In the act of receiving a boat from open water, the boat must maneuver into position for being moored to the dock or within a boat slip of a dock. Maneuvering a boat within the tight confines of a crowded marina may be difficult. Other factors such as the actions of other boaters, wind and weather, inexperience of the person or people handling the boat, inexperience of dock workers, and human error may make maneuvering a boat within the marina and around the dock difficult.

People use lines or ropes to aid in controlling movement of the boat. In order for a line to be used to help control the boat, the line must be attached to an object outside of the boat. A line attached to the dock may be thrown by a dock worker to a person on the boat. However, the throwing distance and throwing accuracy of the dock worker may vary. Further, if the dock worker is on break, the boat may have to wait for some time to get thrown a line. In conditions of high wind, a boat may not be able to maintain a static position within the marina while a dock worker is called upon, causing the boat to have to re-exit the marina and wait until a dock worker becomes available.

Once a boat is within a boat slip, the boat must be moored or securely affixed in a safe position and orientation to avoid the boat moving and being damaged by contact with the dock or neighboring boats. Lines may be lashed to cleats on the boat and the dock to secure the boat in place.

SUMMARY

This Summary introduces a selection of concepts in a simplified form that are further described below in the Detailed Description. This Summary is not intended to limit the scope of the claimed subject matter and does not necessarily identify each and every key or essential feature of the claimed subject matter.

A system for providing a line to a boat is provided. The system includes the line attached to a portion of a dock and a line tending unit configured for selectively operating in a stowed state and in a deployed state. The line tending unit includes a line tending arm including an attachment end configured for releasably holding the line and a line tending unit actuator configured to actuate the line tending arm between a stowed condition corresponding to the stowed state and a deployed condition corresponding to the deployed condition. The system further includes a control device in communication with the line tending unit and configured for commanding the line tending unit between the stowed state and the deployed state.

In some embodiments, the line tending unit operating in the deployed state includes extending the line tending arm outwardly over the surface of a body of water.

In some embodiments, the system further includes the dock including a bollard. The line tending unit is attached to the bollard.

In some embodiments, the line tending unit, when in the stowed state, further includes the line tending arm in a parallel condition to the longitudinal axis of the bollard. The line tending unit, when in the deployed state, further includes the line tending arm forming an oblique angle relative to the longitudinal axis of the bollard.

In some embodiments, the portion of the dock includes the bollard.

In some embodiments, the system further includes the dock. The dock includes a horizontal surface and a vertical surface adjacent to and below the horizontal surface. The line tending unit is attached to the vertical surface.

In some embodiments, the line tending unit, when in the stowed state, further includes the line tending arm in a horizontal orientation parallel to the vertical surface of the dock.

In some embodiments, the line tending unit actuator includes a battery, an electric motor, and a wireless communications device configured for receiving a command from the control device. The line tending unit actuator further includes a computerized or electronic controller in communication with the wireless communication device and configured for controlling the electric motor based upon the command.

In some embodiments, the control device includes a push-button device configured for transmitting a radio frequency signal including the command to the line tending unit actuator.

In some embodiments, the control device includes a cellular device configured for providing the command to the line tending unit actuator.

In some embodiments, the control device includes a wire harness connecting the control device to the line tending unit actuator.

In some embodiments, the line tending arm includes a counterweight.

In some embodiments, the system further includes a solar panel configured for providing electrical energy to the line tending unit actuator.

In some embodiments, the system further includes a replaceable, rechargeable battery pack configured for selective attachment to the line tending unit actuator and for providing electrical energy to the line tending unit actuator.

In some embodiments, the line includes a first line. The system further includes the boat, a second line, and the dock. The dock includes a boat slip configured for receiving the boat; and a line tensioning unit configured for, when the second line is attached to the boat, selectively providing tension to the second line.

In some embodiments, the line tensioning unit includes a cleat rail and a cleat carrier device. The cleat carrier device includes a cleat and is configured for moving along the cleat rail.

According to one alternative embodiment, a system for providing a line to a boat is provided. The system includes a dock including a bollard. The system further includes the line attached to a portion of the dock and a line tending unit attached to the bollard. The line tending unit is configured for selectively operating in a stowed state and in a deployed state. The line tending unit includes a line tending arm including an attachment end configured for releasably holding the line and a line tending unit actuator configured to actuate the line tending arm between a stowed condition corresponding to the stowed state and a deployed condition corresponding to the deployed condition. The line tending unit actuator includes an electric motor, a wireless communications device configured for receiving a command from the control device, and a computerized or electronic controller in communication with the wireless communication device. The computerized or electronic controller is configured for controlling the electric motor based upon the command. The system further includes a control device in communication with the line tending unit and configured for commanding the line tending unit between the stowed state and the deployed state.

In some embodiments, the line includes a first line. The system further includes the boat and a second line. The dock further includes a boat slip configured for receiving the boat and a line tensioning unit configured for, when the second line is attached to the boat, selectively providing tension to the second line.

According to one alternative embodiment, a device for providing a line to a boat is provided. The device includes a line tending unit configured for selectively operating in a stowed state and in a deployed state. The line tending unit includes a line tending arm including an attachment end configured for releasably holding the line and a line tending unit actuator configured to actuate the line tending arm between a stowed condition corresponding to the stowed state and a deployed condition corresponding to the deployed condition.

In some embodiments, the line tending unit actuator includes an electric motor and a wireless communications device configured for receiving a command from the control device. The line tending actuator further includes a computerized or electronic controller in communication with the wireless communication device and configured for controlling the electric motor based upon the command.

Other features and advantages of the present disclosure will be readily appreciated, as the same becomes better understood, after reading the subsequent description taken in conjunction with the accompanying drawings.

DETAILED DESCRIPTION

Figure 1:
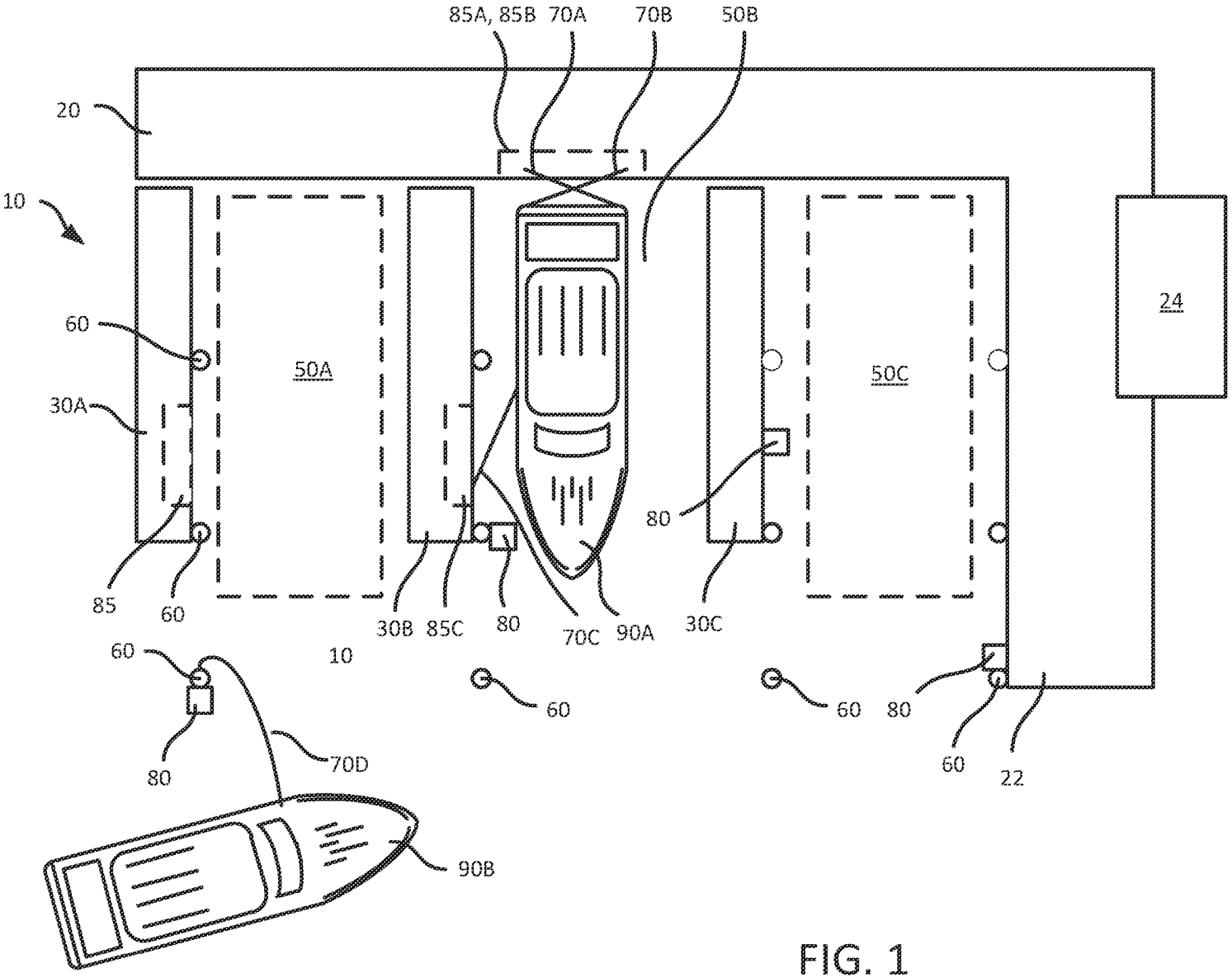
FIG. 1 schematically illustrates a marina in top down view including a dock, a plurality of boat slips, a plurality of boats, a plurality of line tending units each configured for providing a line to a boat, and a plurality of line tensioning units each configured for tensioning a line attached to a boat, in accordance with the present disclosure.

Referring now to the drawings, wherein like numerals indicate like or corresponding parts throughout the several views, FIG. 1 schematically illustrates a marina in top down view including a dock 10, a plurality of boat slips 50A, 50B, 50C, a plurality of boats 90A, 90B, a plurality of line tending units 80, each configured for providing a line 70D to a boat, and a plurality of line tensioning units 85A,85B, 85C each configured for tensioning a line 70A, 70B, 70C attached to a boat 90A, 90B. The dock 10 may include a concrete dock portions 20, 22 and dock sections 30A, 30B, 30C. The dock 10 may further include a plurality of bollards 60 or wooden posts driven into a bed underneath water. The dock 10 is provided as a non-limiting example of how a dock 10 may be constructed. The dock 10 provides and defines the location of a plurality of boat slips 50A, 50B, 50C in which a boat 90A, 90B may be moored. Boat 90A is illustrated moored within boat slip 50B defined between dock sections 30B and 30C.

Boat 90B is illustrated floating nearby the dock 10. Navigating the boat 90B into one of the open dock slips 50A or 50C may be difficult. A line 70D may be secured to a portion of the dock 10 such as one of the plurality of bollards 60 and may enable a person upon the boat 90B to apply a pulling force upon the line 70D to guide the boat 90B into a desired position and desired orientation. Getting a line 70D into the possession of a person upon boat 90B may be difficult. For instance, some bollards 60 are away from the dock sections 30A, 30B, 30C, such that a dock worker may be able to reach a line 70D secured to a bollard 60 away from the dock sections 30A, 30B, 30C. Further, a dock worker may not be available to throw a line 70D to the boat 90B at a time desired by the operator of the boat 90B. A line tending unit 80 is disclosed which may selectively alternate between a stowed state, in which the line 70D is retracted and kept from interfering with passing boats 90A, 90B, and a deployed state, in which the line 70D is suspended outwardly over a water surface such that a person upon the boat 90B may acquire an end portion of the line 70D.

The dock 10 further includes a plurality of line tensioning units 85A, 85B, 85C, each configured for providing tension to lines 70A, 70B, 70C positioned to moor or securely hold boat 90A in place within the boat slip 50B.

A harbormaster's office 24 is illustrated. A worker within the harbormaster's office may control or facilitate various aspects of the illustrated dock 10.

Figure 2:
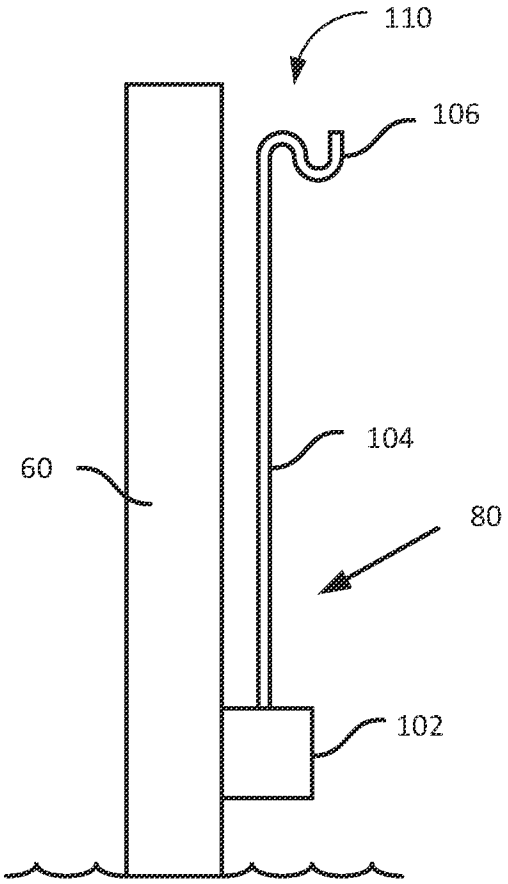
FIG. 2 schematically illustrates a line tending unit of FIG. 1 attached to a bollard within the marina of FIG. 1, wherein the line tending unit is in a stowed state, in accordance with the present disclosure.

FIG. 2 schematically illustrates a line tending unit of FIG. 1 attached to a bollard 60 within the marina of FIG. 1, wherein the line tending unit 80 is in a stowed state 110. The line tending unit 80 is illustrated including a line tending unit actuator 102, a line tending arm 104, and an attachment end 106. The line tending unit actuator 102 is illustrated attached to the bollard 60. The line tending arm 104 is attached to the line tending unit actuator 102 and is controlled by the line tending unit actuator 102. In one embodiment, the line tending unit actuator 102 includes an electric motor therewithin and uses the electric motor to control one of a position or an orientation of the line tending arm 104. The line tending arm 104 may be formed unitarily with the attachment end 106 which may include one or more features configured to securely hold an end of line 70D of FIG. 1.

The line tending arm 104 may be constructed with a material resilient enough to hold a line over water for extended periods of time. In one embodiment, the line tending arm 104 may be constructed with metal such as aluminum or steel. The aluminum or steel material may be coated with rubber or another polymer to resist corrosion and make the material less likely to scratch the boat 90B of FIG. 1. In another embodiment, the line tending arm 104 may be constructed with a polymer and may be constructed with stiffening or reinforcing ribs, with an exemplary I-shaped or star-shaped cross section. In another embodiment, a portion of the line tending arm 104 may constructed with a metal for stiffness and rigidity, and another portion including the attachment end 106 may be constructed with a flexible polymer to avoid accidental contact between the line tending arm 104 and the boat 90B scratching the boat 90B. In one embodiment, the line tending arm 104 may have a fixed length. In another embodiment, the line tending arm 104 may be extendable and retractable. Extension may be accomplished through a set of concentric tubes, each of differing diameters, loaded one inside of the other. Extension may be accomplished by having two bars aligned side by side with an adjustable bracket fixing the bars together in a selectable configuration. In one embodiment, the extension and retraction may be manually performed, for example, with a set screw, constriction band, or other mechanical device enabling a user to fix a length of the line tending arm 104.

Figure 3:
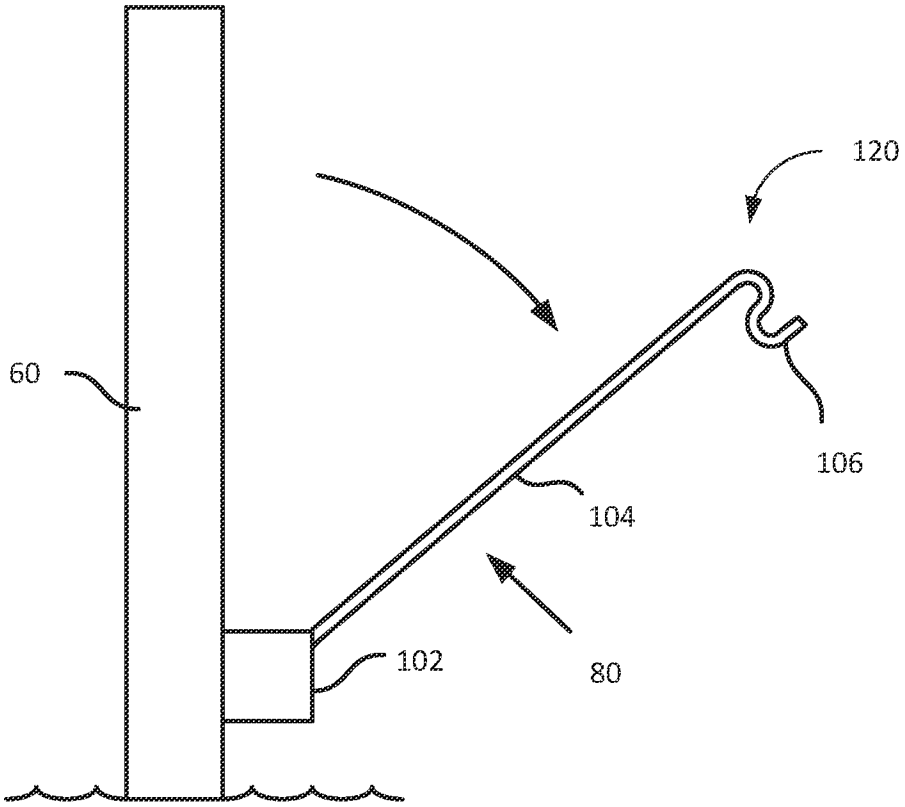
FIG. 3 schematically illustrates the line tending unit of FIG. 2 in a deployed state, in accordance with the present disclosure.

FIG. 3 schematically illustrates the line tending unit 80 of FIG. 2 in a deployed state 120. The line tending unit 80 is illustrated including the line tending unit actuator 102, the line tending arm 104, and the attachment end 106. The line tending unit actuator 102 is illustrated attached to the bollard 60. The line tending unit actuator 102 has been activated or commanded to move the line tending arm 104 into an orientation projecting the attachment end 60 out over a surface of nearby water. In this orientation in deployed state 120, a person upon the boat 90B of FIG. 1 may easily retrieve the line 70D attached to the attachment end 106. In the embodiment of FIGS. 2 and 3, the line tending arm 104 may be described as alternating between a deployed condition corresponding to the line tending unit 80 being in the deployed state and a stowed condition corresponding to the line tending unit 80 being in the stowed state.

Figure 4:
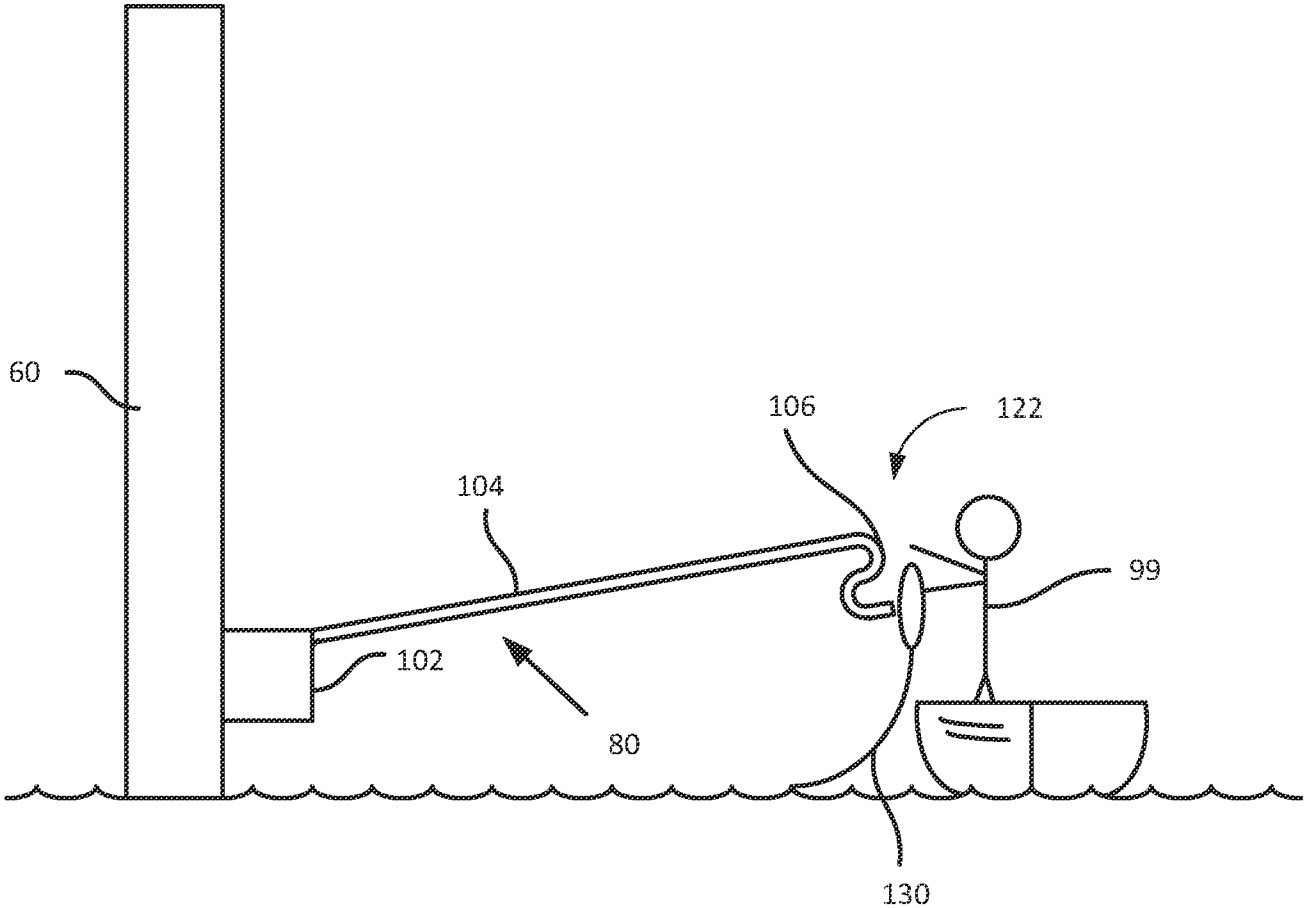
FIG. 4 schematically illustrates the line tending unit of FIG. 2 in a loading state, wherein a dock worker may attach a line for subsequent use of the line tending unit in the stowed state and then the deployed state, in accordance with the present disclosure.

FIG. 4 schematically illustrates the line tending unit 80 of FIG. 2 in a loading state 122, wherein a dock worker 99 may attach a line end portion 130 for subsequent use of the line tending unit 80 in the stowed state 110 and then the deployed state 120. The line tending unit 80 is illustrated including the line tending unit actuator 102, the line tending arm 104, and the attachment end 106. The line tending unit actuator 102 is illustrated attached to the bollard 60. The line tending unit actuator 102 has been activated or commanded to move the line tending arm 104 into an orientation projecting the attachment end 60 out over a surface of nearby water in a low position such that the dock worker 99 in a small boat may reach the attachment end 106 and attach the line end portion 130 thereto. A position of the arm in each of the stowed state 110, the deployed state 120, and the loading state 122 may be configurable, for example, with a cellular phone application being useful to set an angle of the line tending arm 104 in each of the states 110, 120, 122.

Figure 5:
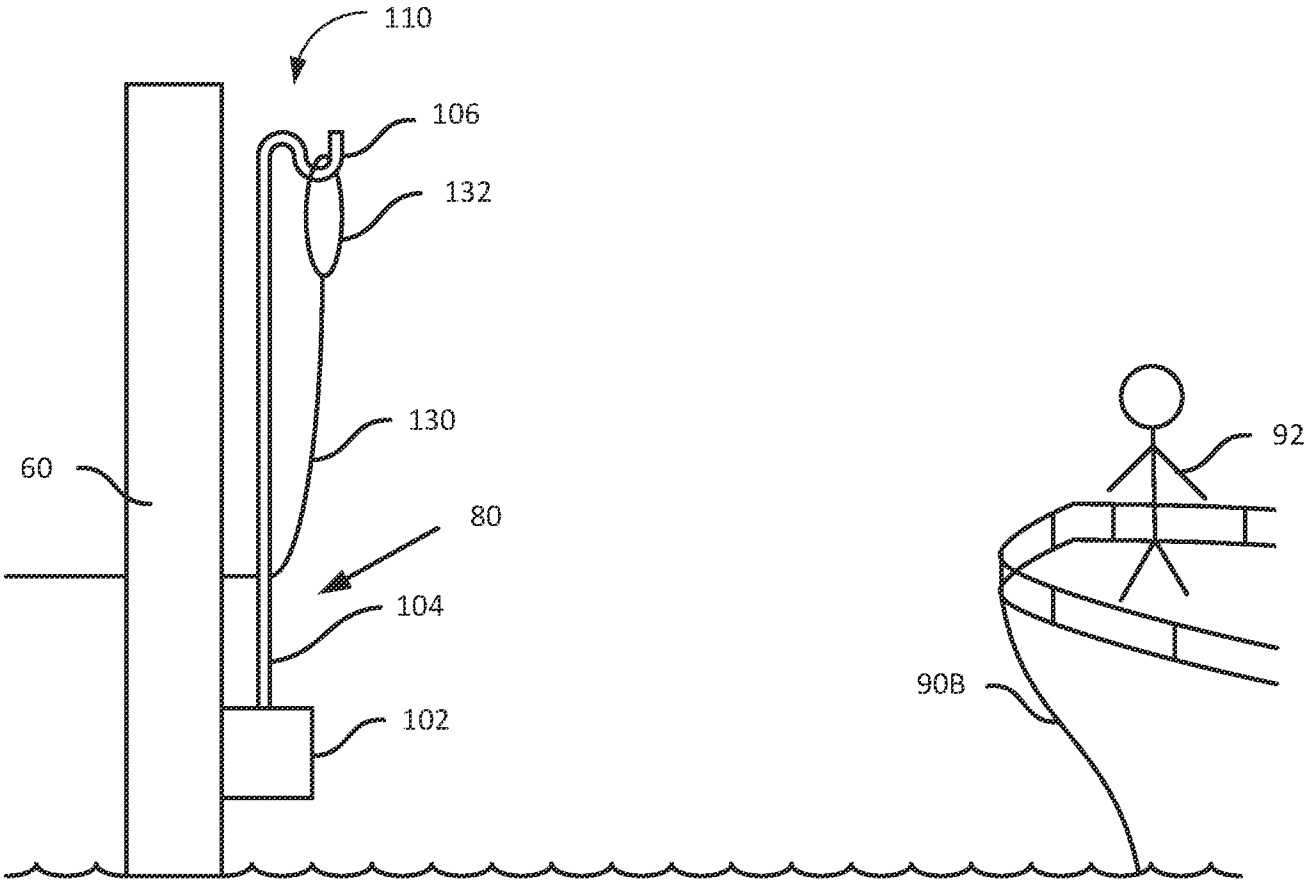
FIG. 5 schematically illustrates the line tending unit of FIG. 2 in the stowed state, with a line attached thereto, and with a boat approaching the line tending unit, in accordance with the present disclosure.

FIG. 5 schematically illustrates the line tending unit 80 of FIG. 2 in the stowed state 110, with a line end portion 130 attached thereto, and with the boat 90B including person 92 approaching the line tending unit 80. The line tending unit 80 is illustrated including the line tending unit actuator 102, the line tending arm 104, and the attachment end 106. The line tending unit actuator 102 is illustrated attached to the bollard 60. The line end portion 130 may be a portion of the line 70D of FIG. 1. The line end portion 130 may include a straight line without any loops. The line end portion 130 may include a looped end 132 configured for easy retention upon the attachment end 106. The line 70D may be attached to the bollard 60, to a cleat upon the dock section 30A of FIG. 1, to a submerged anchor, or to another secured object.

Figure 6:
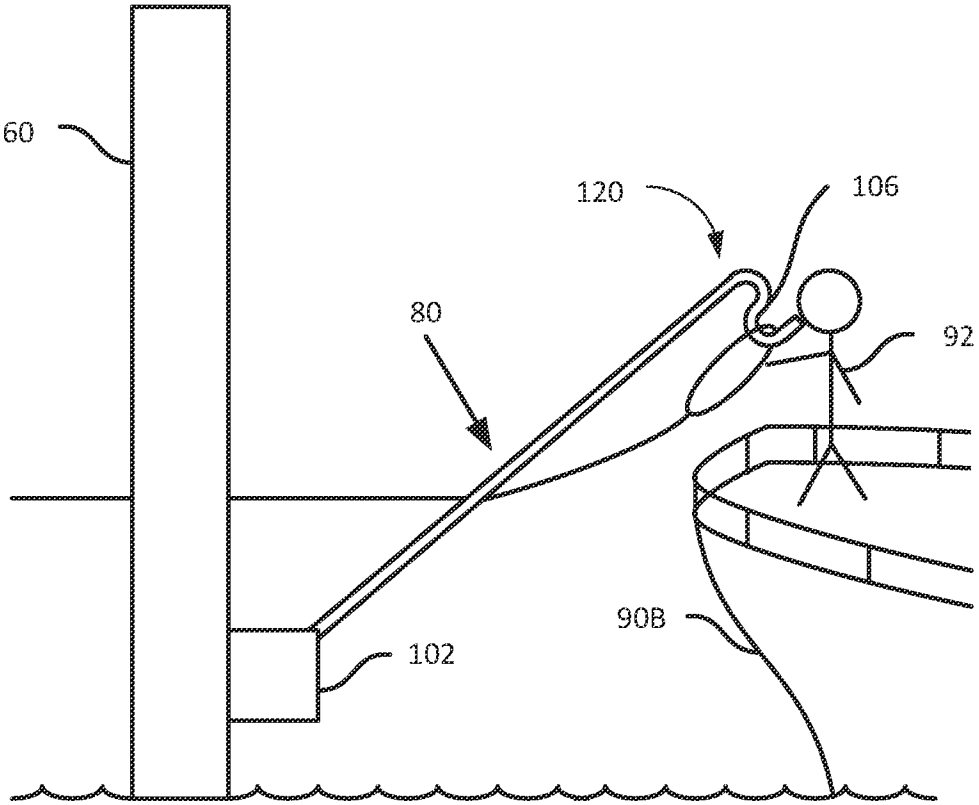
FIG. 6 schematically illustrates the line tending unit of FIG. 5 in the deployed state, with a person upon the boat of FIG. 5 acquiring the line attached to the line tending unit, in accordance with the present disclosure.

FIG. 6 schematically illustrates the line tending unit 80 of FIG. 5 in the deployed state 120, with the person 92 upon the boat 90B of FIG. 5 acquiring the line end portion 130 of FIG. 5 attached to the line tending unit 80. The line tending unit actuator 102 is illustrated attached to the bollard 60. The line tending unit 80 is illustrated including the line tending unit actuator 102 having moved the attachment end 106 out over a surface of the nearby water in accordance with the deployed state 120. The boat 90B remains distant from the bollard 60, avoiding any impact between the two, while providing the person 92 with easy access to the attachment end 106 and the attached line.

Figure 7:
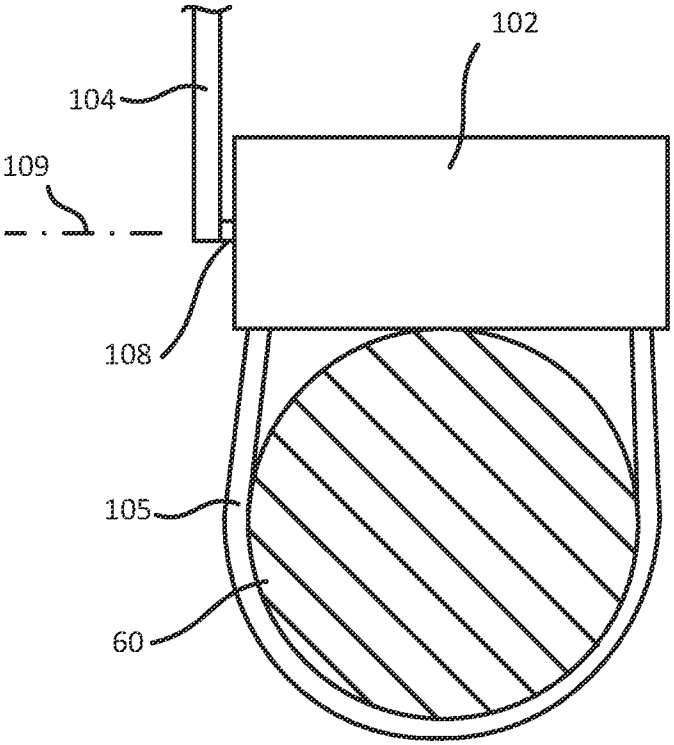
FIG. 7 schematically illustrates a first exemplary configuration for attaching the line tending unit of FIG. 2 to the bollard, in accordance with the present disclosure.

FIG. 7 schematically illustrates a first exemplary configuration for attaching the line tending unit 80 of FIG. 2 to the bollard 60. The line tending unit actuator 102 is illustrated including the line tending arm 104 connected to the line tending unit actuator 102 with a rotating shaft 108 configured for rotating about an axis of rotation 109. The line tending unit actuator 102 is illustrated attached to the bollard 60 with a strap 105 wrapped around the bollard 60 and attached at both ends to a casing of the line tending unit actuator 102.

Figure 8:
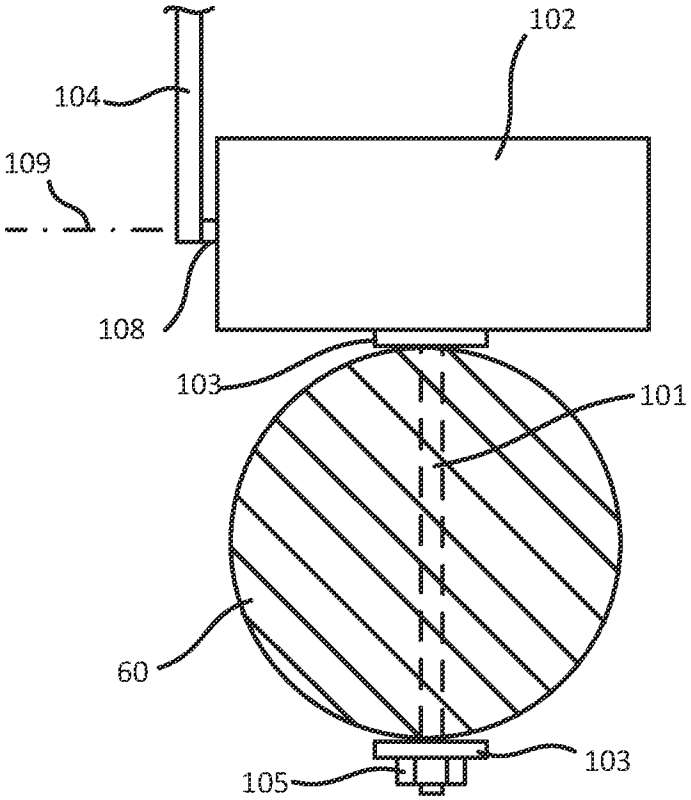
FIG. 8 schematically illustrates a second exemplary configuration for attaching the line tending unit of FIG. 2 to the bollard, in accordance with the present disclosure.

FIG. 8 schematically illustrates a second exemplary configuration for attaching the line tending unit 80 of FIG. 2 to the bollard 60. The line tending unit actuator 102 is illustrated including the line tending arm 104 connected to the line tending unit actuator 102 with a rotating shaft 108 configured for rotating about an axis of rotation 109. The line tending unit actuator 102 is illustrated attached to the bollard 60 with a bolt 101 and a nut 105. A first washer 103 separates the line tending 102 from the bollard 60, and a second washer 103 separates the nut 105 from the bollard 60. A method for attaching a line tending unit 80 of FIG. 2 to a bollard 60 may take many different forms. The exemplary methods of FIGS. 7 and 8 disclosed herein are provided as non-limiting examples.

Figure 9:
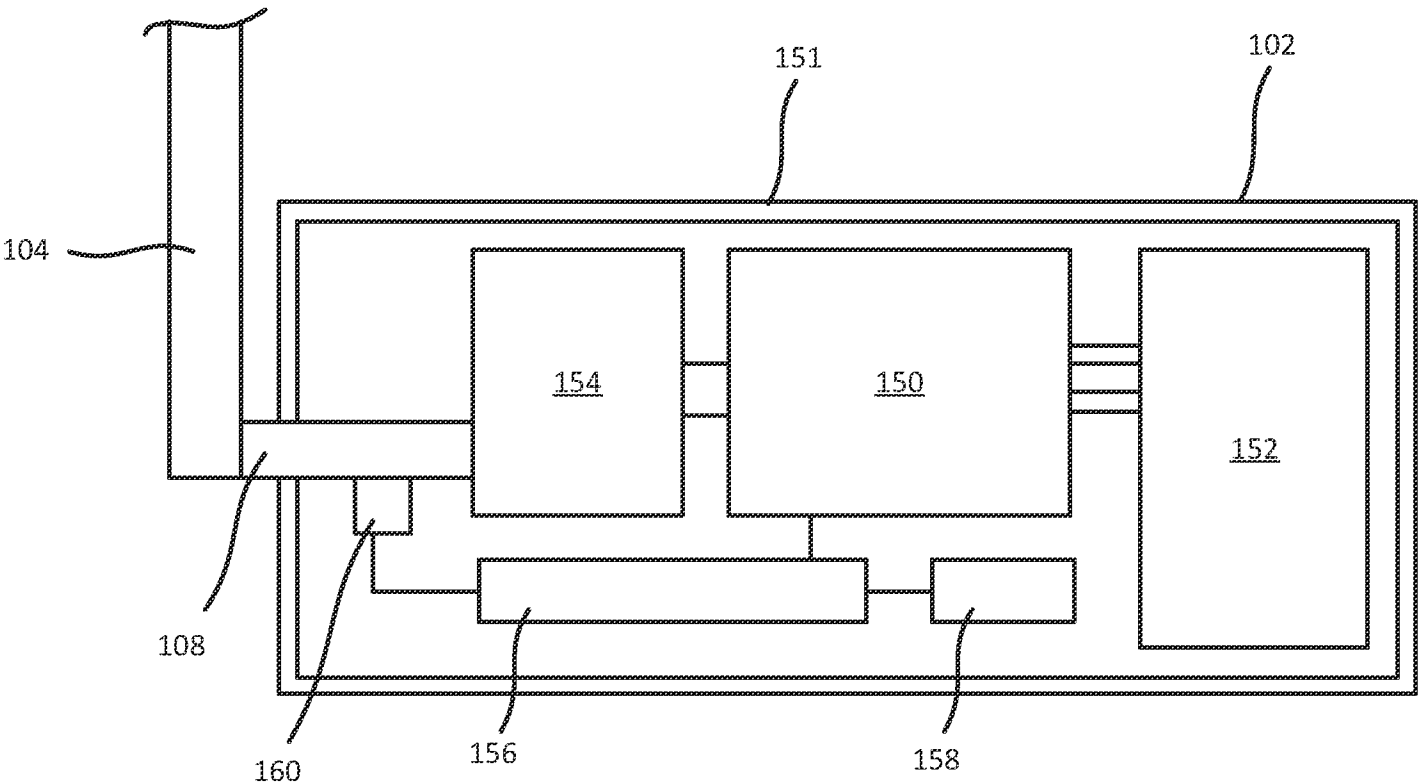
FIG. 9 schematically illustrates an exemplary line tending unit actuator and components thereto, in accordance with the present disclosure.

FIG. 9 schematically illustrates an exemplary line tending unit actuator 102 and components thereto. The line tending unit actuator 102 is illustrated including an electric motor 150, a battery 152, a gear box 154, and the output shaft 108. The output shaft 108 is connected to the line tending arm 104 and controls an orientation or position thereof.

Operation of the electric motor 150 is used to control rotation of the output shaft 108. Control over the electric motor 150 may be performed by a controller located outside of the line tending unit actuator 102. In the illustrated embodiment, a computerized or electronic controller 156 is illustrated in communication with the electric motor 150 and controls operation thereof. An optional wireless communications device 158 is illustrated in communication with the computerized or electronic controller 156 and provides an exemplary channel of communication for a user to command activation of the line tending unit 80 of FIG. 2 from one state to a second state. The wireless communications device 158 may be a cellular communications device, a radio frequency communications device, or may utilize other wireless means of communication in the art. In another optional construction, a wire harness or a communications wire may be utilized to provide power and/or communicative data from outside of the line tending unit actuator 102. A sensor 160 may be utilized to monitor and provide data regarding rotation of the output shaft 108. The battery 152 may be rechargeable and/or replaceable and may provide direct current electrical power to the electric motor. In another embodiment, the battery 152 may be omitted, and a wire harness may be utilized to provide electrical power to the electric motor 150, for example, through an alternating current infrastructure power source. A casing 151 is illustrated encapsulating the components of the line tending unit actuator 102.

Figure 10:
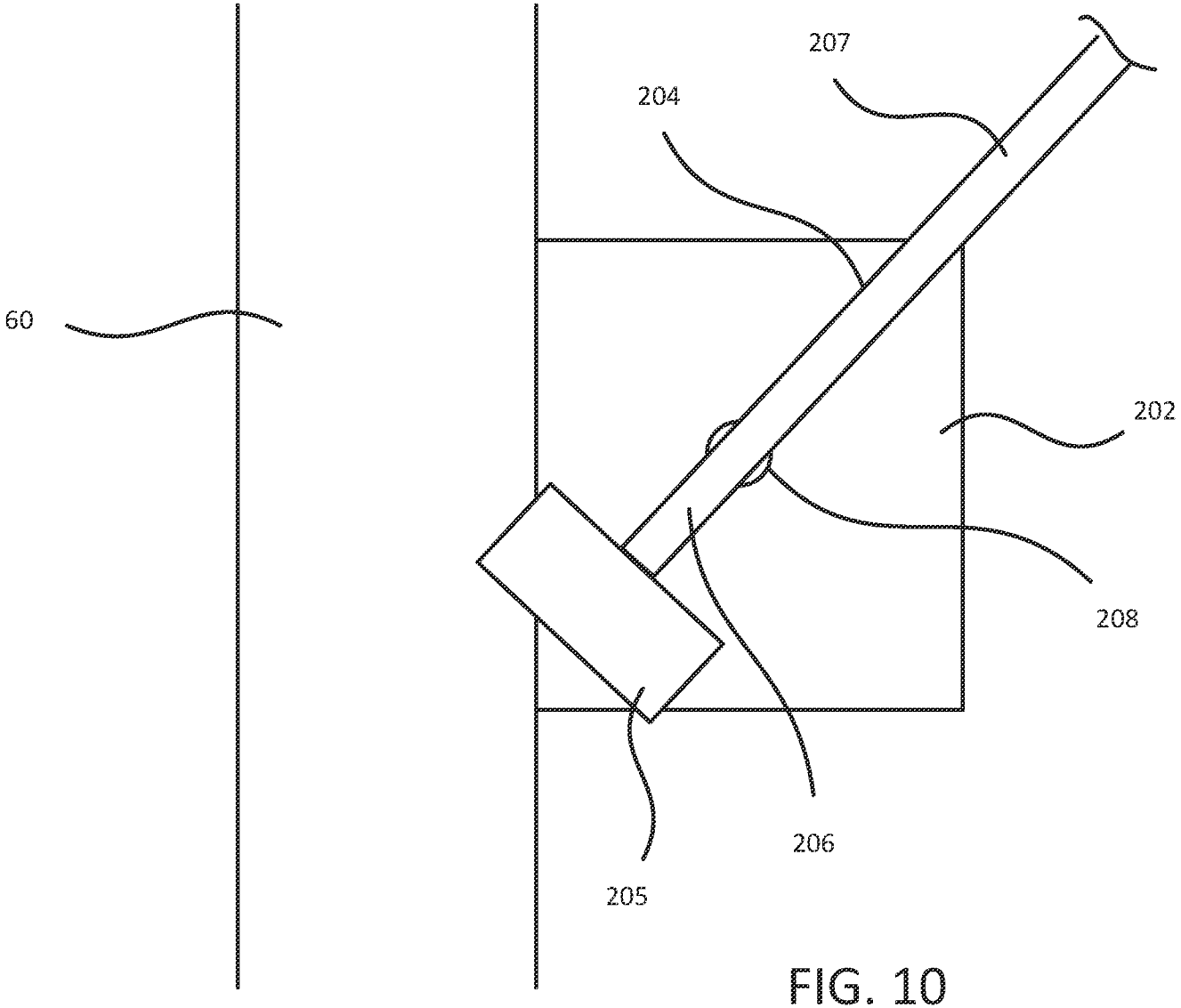
FIG. 10 schematically illustrates an exemplary line tending unit including a counterweight configured for balancing the line tending arm, in accordance with the present disclosure.

FIG. 10 schematically illustrates an exemplary line tending unit actuator 202 connected to a line tending arm 204 including a counterweight 205 configured for balancing the line tending arm 204. The line tending unit actuator 202 is illustrated attached to bollard 60. The line 70D of FIG. 1 may be heavy. If the line 70D is water soaked, it will be even heavier. In the absence of the counterweight 205, extending the weight of the line tending arm 204 plus the weight of the line 70D over the water may cause a large moment to be applied to the line tending arm 204 at the output shaft 208. The illustrated line tending arm 204 includes a first portion 207 on a first side of the output shaft 208 and a second portion 206 on a second side of the output shaft 208, with the counterweight 205 being attached to the second portion 206. The line tending unit 202 connected to the line tending arm 204 including the counterweight 205 reduces the moment applied to the output shaft 208 by the weight of the line tending arm 204 and the weight of the line 70D attached to the line tending arm 204. As a result, an output torque required to be provided by the line tending unit actuator to control the line tending arm 204 may be reduced.

Figure 11:
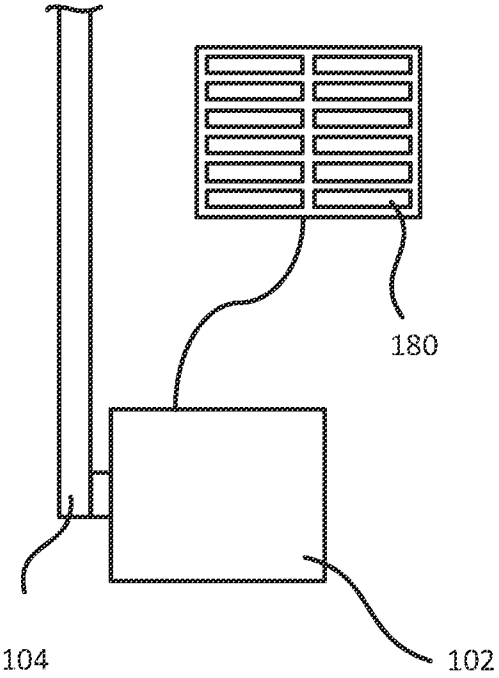
FIG. 11 schematically illustrates the line tending unit of FIG. 2 including a solar panel useful to charge a battery within the line tending unit, in accordance with the present disclosure.

The electric motor of the line tending unit 80 of FIG. 2 utilizes electrical energy to actuate or move the line tending arm 104 from one state to another state. This electrical energy may be provided to the line tending unit 80 in a number of exemplary ways. FIG. 11 schematically illustrates the line tending unit 80 of FIG. 2 including a solar panel 180 useful to charge a battery within the line tending unit actuator 102. The solar panel 180 transforms solar energy into electrical energy which is provided to the line tending unit actuator 102 to charge a battery therewithin. The battery provides electrical energy which the line tending unit actuator 102 may selectively utilize to actuate or move the line tending arm 104.

Figure 12:
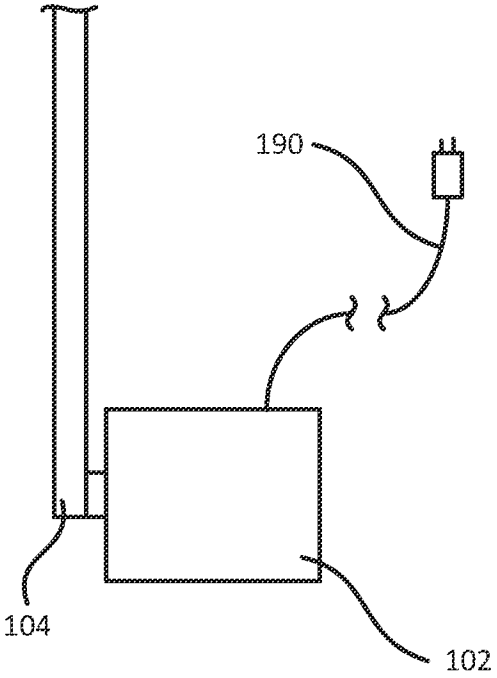
FIG. 12 schematically illustrates the line tending unit of FIG. 2 including an alternating current power cable configured for providing power to the line tending unit, in accordance with the present disclosure.

FIG. 12 schematically illustrates the line tending unit 80 of FIG. 2 including an alternating current power cable 190 configured for providing electrical energy to the line tending unit actuator 102. The line tending unit actuator 102 may utilize the electrical energy from the power cable 190 directly, providing power to the electric motor within the line tending unit actuator 102. In another embodiment, the line tending unit actuator 102 may utilize the electrical energy from the power cable 190 to charge a battery therewithin, which may in turn provide electrical energy to the electric motor within the line tending unit actuator 102. The power cable 190 may be suspended from a remote elevated pole to an exemplary bollard to which the line tending unit 80 is attached. In another embodiment, the power cable 190 may be submerged under a surface of nearby water to a bottom of the bollard and may run up a side of the bollard to the line tending unit 80.

Figure 13:
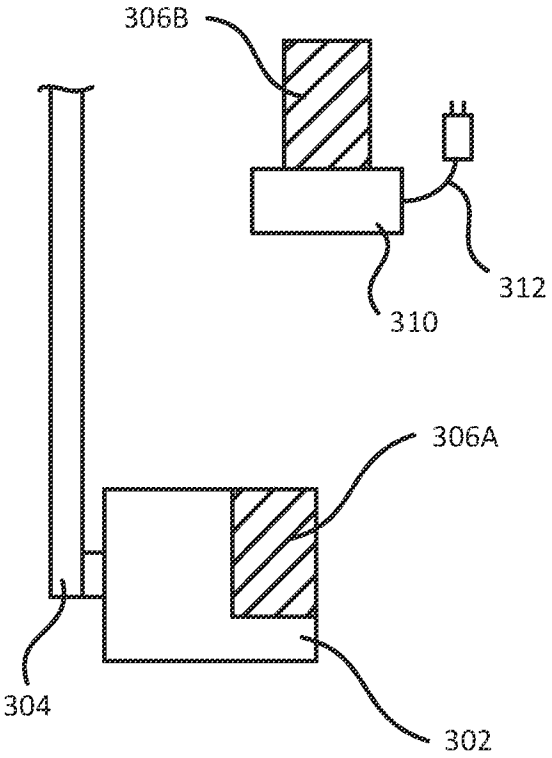
FIG. 13 schematically illustrates an exemplary line tending unit including a replaceable, rechargeable battery pack, in accordance with the present disclosure.

FIG. 13 schematically illustrates an exemplary line tending unit 80 of FIG. 2 including a replaceable, rechargeable battery pack 306A. An alternative embodiment line tending unit actuator 302 is illustrated including an externally accessible replaceable, rechargeable battery pack 306A. The replaceable, rechargeable battery pack 306A provides electrical energy to the line tending unit actuator 302 which may utilize that electrical energy to actuate or move line tending arm 304. A plurality of replaceable, rechargeable battery packs 306A, 306B may be provided, wherein replaceable, rechargeable battery pack 306B may be charged upon remote charger device 310 including power cable 312 while the replaceable, rechargeable battery pack 306A is connected to and provides electrical energy to the line tending unit actuator 302. When the replaceable, rechargeable battery pack 306A is depleted or reaches a low state of charge, a worker may remove the replaceable, rechargeable battery pack 306A from the line tending unit actuator 302, install the replaceable, rechargeable battery pack 306B to the line tending unit actuator 302, and then utilize the remote charger device 310 to recharge the replaceable, rechargeable battery pack 306A. The replaceable, rechargeable battery pack 306A may be configured to quickly snap or click into place upon the line tending unit actuator 302. In another embodiment, the replaceable, rechargeable battery pack 306A may be affixed to or fastened to the line tending unit actuator 302 with one or more threaded fasteners. In another embodiment, the replaceable, rechargeable battery pack 306A may be contained within a casing of the line tending unit actuator 302, and, when the replaceable, rechargeable battery pack 306A is replaced, the worker may open the casing of the line tending unit actuator 302 replace the replaceable, rechargeable battery pack 306A, and re-close the casing.

Figure 14:
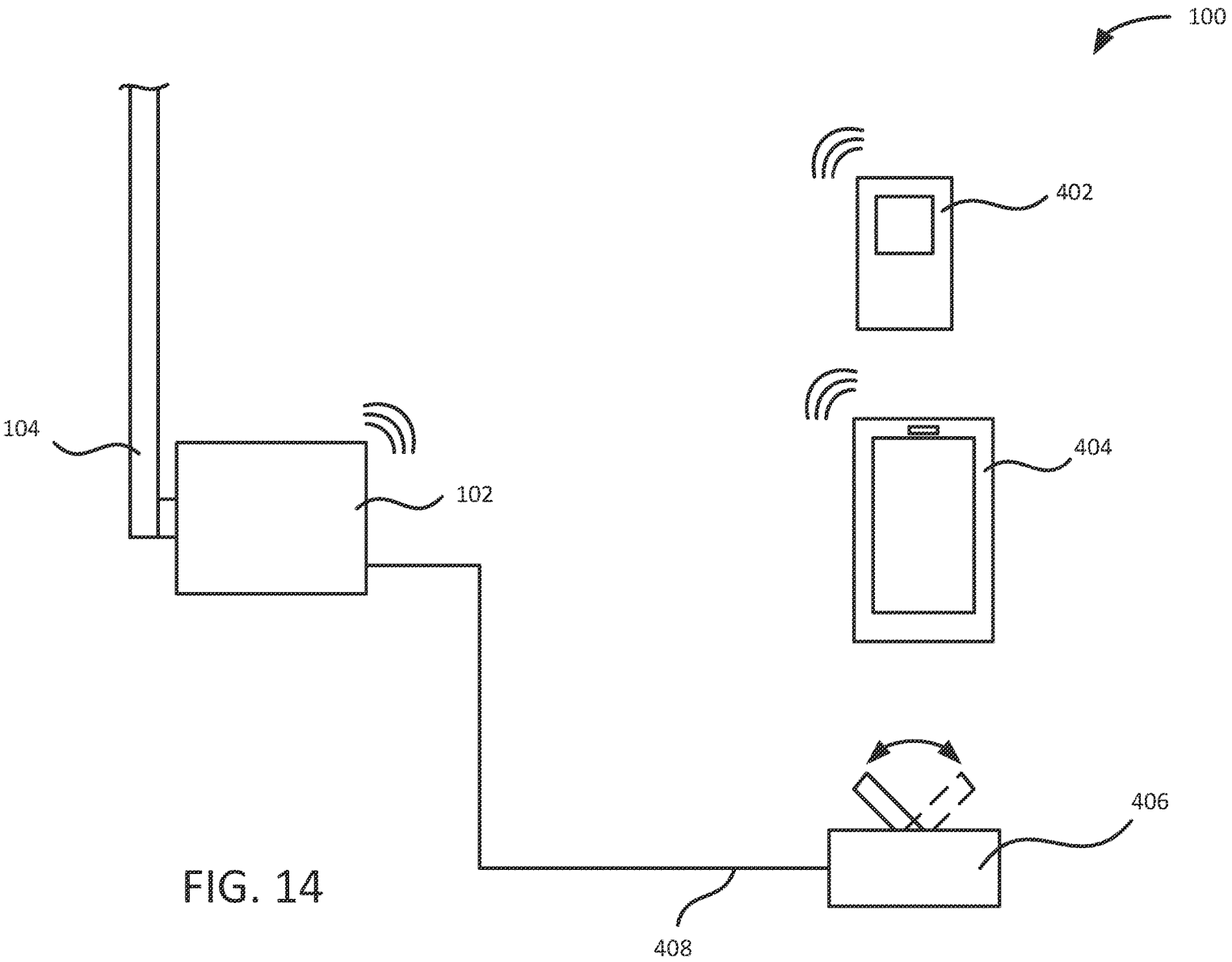
FIG. 14 schematically illustrates an exemplary system for providing a line to a boat including the line tending unit of FIG. 2 and a plurality of exemplary control devices, in accordance with the present disclosure.

FIG. 14 schematically illustrates an exemplary system 100 for providing a line 70D to a boat 90B including the line tending unit 80 of FIG. 2 and a plurality of exemplary control devices 402, 404, 406. The line tending unit actuator 102 receives commands from one or more of the control devices 402, 404, 406 and controls actuation or movement of the line tending arm 104.

The control device 402 is illustrated embodied as a push button radio frequency controller similar to a garage door opener device in the art. Upon a button or switch upon the control device 402 being activated, a circuit board within the control device 402 may generate a radio frequency signal which may be received by the line tending unit actuator 102. Each push of the button upon the control device 402 may result in the line tending unit actuator 102 reversing a command alternatively between a stowed state and a deployed state.

The control device 404 is illustrated embodied as the cellular device. The cellular device may include an operating system enabling operation of software applications upon the cellular device. The control device 404 may command actuation of the line tending unit actuator 102. The control device 404 may include additional or complex commands. In one embodiment, the control device 404 may request a password to enable actuation of the line tending unit actuator 102, for example, enabling the harbor master to charge for use of the disclosed system. In another example, the control device 104 may schedule activation of the line tending unit actuator 102 at a selected time. In another embodiment, a location of the control device 404, for example, as determined by location triangulation with local cellular towers, may be utilized to determine proximity of the control device 404 to a particular line tending unit 80, and the associated line tending unit actuator 102 may automatically actuate into a deployed state based upon the proximity.

The control unit 406 includes an infrastructure control device, for example, including a wire harness 408 directly connecting the control unit 406 to the line tending unit actuator 102. The control unit 406 may be located for a dock worker or a harbor master to command operation of the line tending unit actuator 102.

Figure 15:
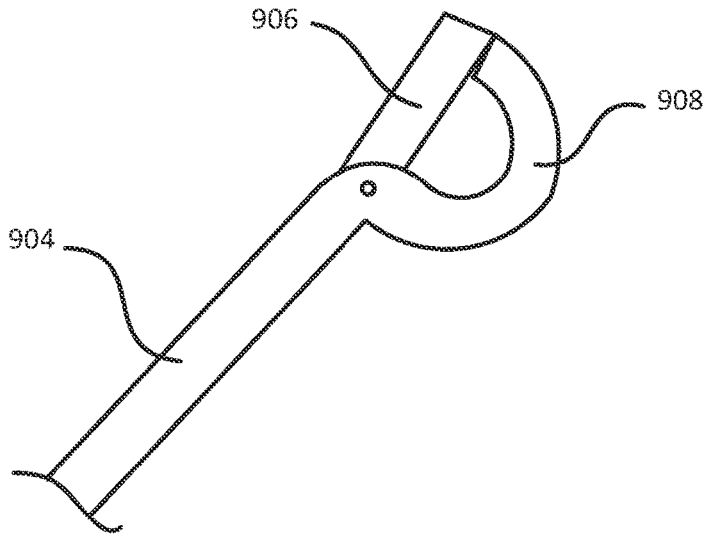
FIG. 15 schematically illustrates an exemplary alternative line retention member for use on a line tending arm, in accordance with the present disclosure.

FIG. 15 schematically illustrates an exemplary alternative attachment end 906 for use on a line tending arm 904. The illustrated attachment end 906 includes a latch 908 configured for retaining a line 70B of FIG. 1 in the attachment end 906. The latch 908 may be spring loaded, may include a locking switch, or may include other similar features for selectively retaining the line 70B within the attachment end 906.

Figure 16:
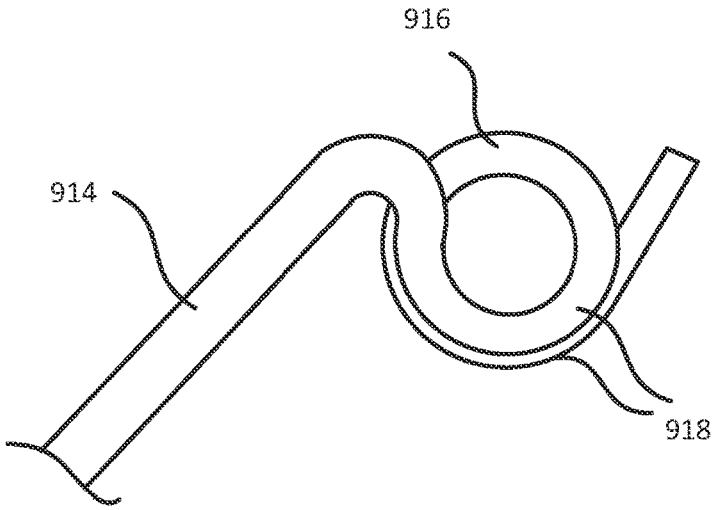
FIG. 16 schematically illustrates an additional exemplary alternative line retention member for use on a line tending arm in side view, in accordance with the present disclosure.
Figure 17:
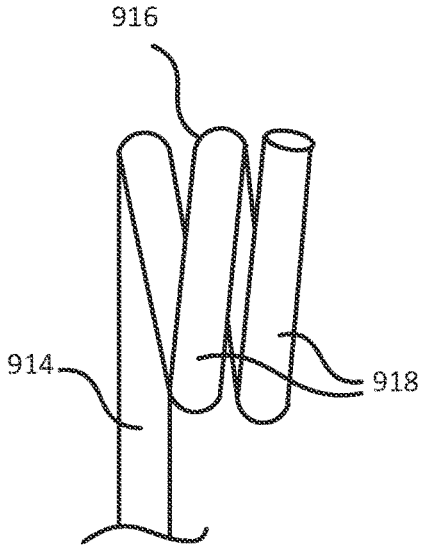
FIG. 17 schematically illustrates the line retention member of FIG. 16 in front view, in accordance with the present disclosure.

FIG. 16 schematically illustrates an additional exemplary alternative attachment end 916 for use on a line tending arm 914 in side view. The attachment end 916 is illustrated including a plurality of windings 918. FIG. 17 schematically illustrates the line retention member 914 of FIG. 16 in front view. The illustrated attachment end 916 including the windings 918 is configured for receiving an end of the line 70D of FIG. 1 and selectively retaining the line 70D between the windings 918.

Figure 18:
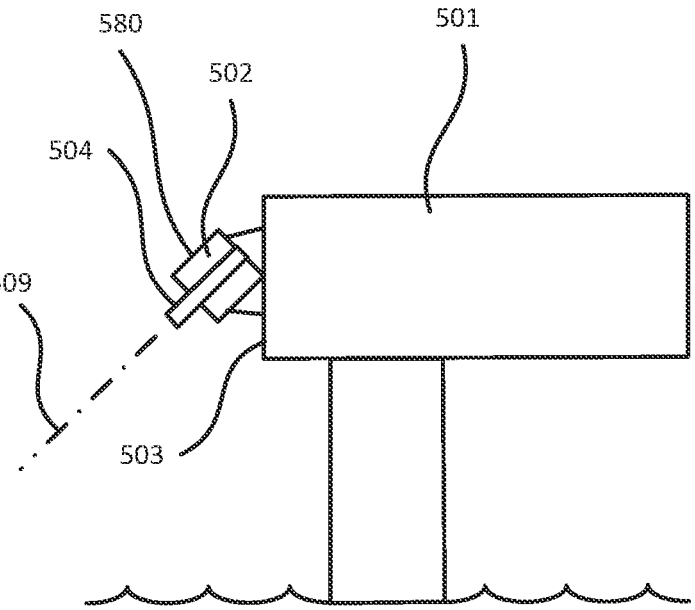
FIG. 18 schematically illustrates an exemplary alternative line tending unit configured for stowing the line tending arm in a horizontal orientation next to a dock, in accordance with the present disclosure.
Figure 19:
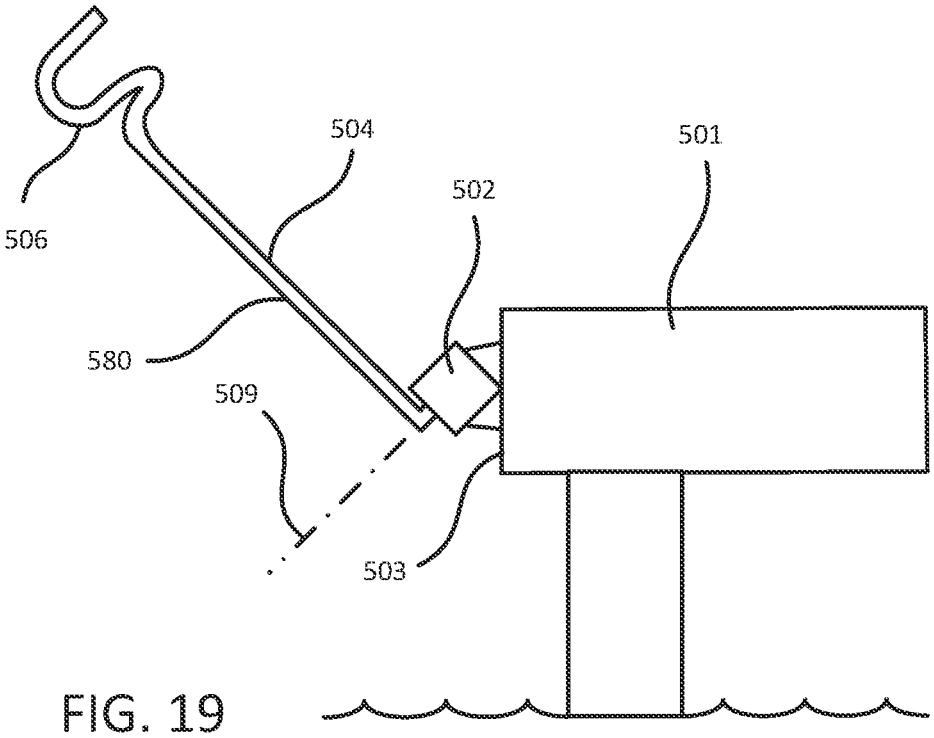
FIG. 19 schematically illustrates the exemplary line tending unit of FIG. 18, with the line tending arm in a deployed state, in accordance with the present disclosure.

FIGS. 18 and 19 schematically illustrate an exemplary alternative line tending unit 580 configured for stowing the line tending arm 504 in a horizontal orientation next to a dock surface 503. The dock 501 is illustrated including a vertical dock surface 503. For aesthetic or functional reasons, the management of the dock 501 may not desire for the line tending arm 504 to be in a vertical orientation when the line tending unit 580 is in the stowed state. The line tending unit 580 is illustrated including a line tending unit actuator 502 including an output shaft including an axis of rotation 509 configured to enable the attached line tending arm 504 to rotate from a horizontal orientation in a stowed state to an upwardly diagonal orientation in a deployed state. FIG. 19 schematically illustrates the exemplary line tending unit 580 of FIG. 18, with the line tending arm 504 in a deployed state with an upwardly diagonal orientation. By providing a line tending unit 580 with an output shaft with a selected axis of rotation 509, the positions and orientations of the line tending arm 504 in the stowed state and the deployed state may be controlled.

The line tending units 80 and 580 are provided as examples of how the disclosed device may be used to selectively extend a line out over water for a person on a boat to acquire. Other embodiments of the line tending units 80 and 580 are envisioned. The line tending arm 104 may translate or move along a longitudinal axis of the line tending arm 104 to be extended out over water. In another embodiment, the line tending arm 104 may be a vertically fixed arm, similar to a crane, that rotates in a horizontal plane to extend the line over water. In another embodiment, the line tending arm 104 may include a robotic arm with one or more articulating joints useful to manipulate the line 70D into a particular position. Such a robotic system may have a vision system attached thereto, with computerized logic being useful to recognize the approach of a boat, see or receive a command to extend the line 70D, and control when and where the robotic arm is extended to.

Figure 20:
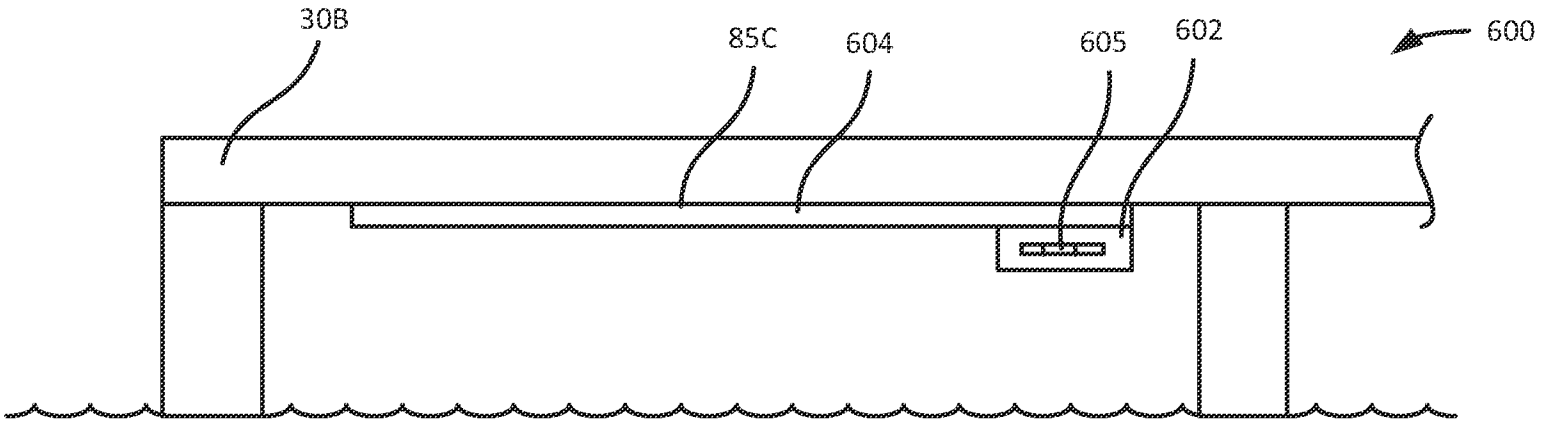
FIG. 20 schematically illustrates the line tensioning unit of FIG. 1 in side view, with the line tensioning unit in a retracted state, in accordance with the present disclosure.
Figure 21:
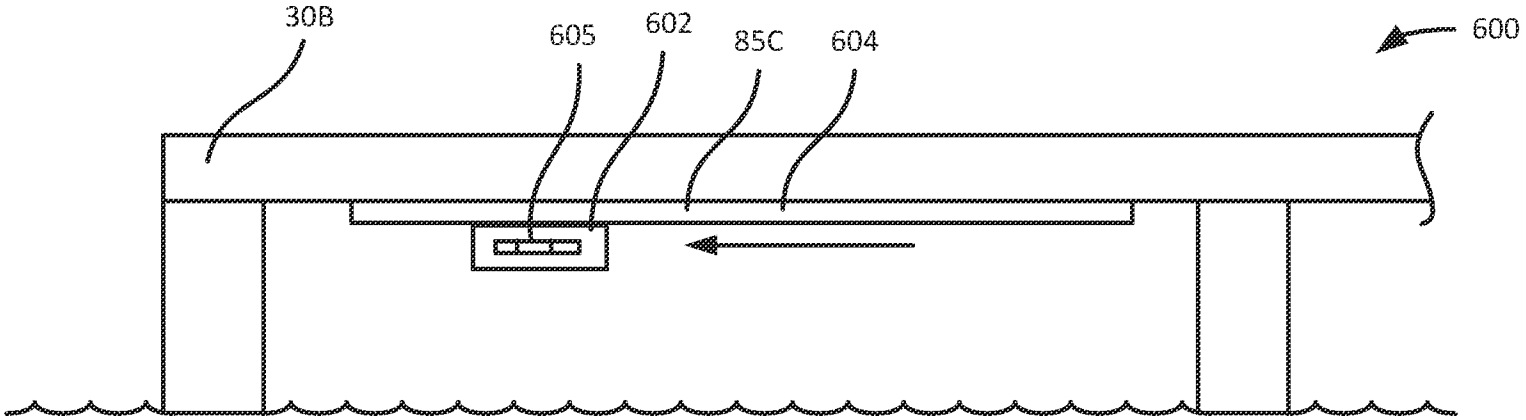
FIG. 21 schematically illustrates the line tensioning unit of FIG. 20 in side view, with the line tensioning unit in an extended state, in accordance with the present disclosure.

FIGS. 20 and 21 schematically illustrate the line tensioning unit 85C of FIG. 1 in side view. The line tensioning unit 85C is illustrated attached to a dock section 30B including a cleat carrier device 602 configured for movement along a cleat rail 604. The clear carrier device 602 includes a cleat 605 attached thereto. Cleat 605 is a device in the art for securing a line to a boat 90A, dock 10, or other similar feature. FIG. 20 illustrates the line tensioning unit 85C in the retracted state. FIG. 21 illustrates the line tensioning unit 85C in an extended state.

Figure 22:
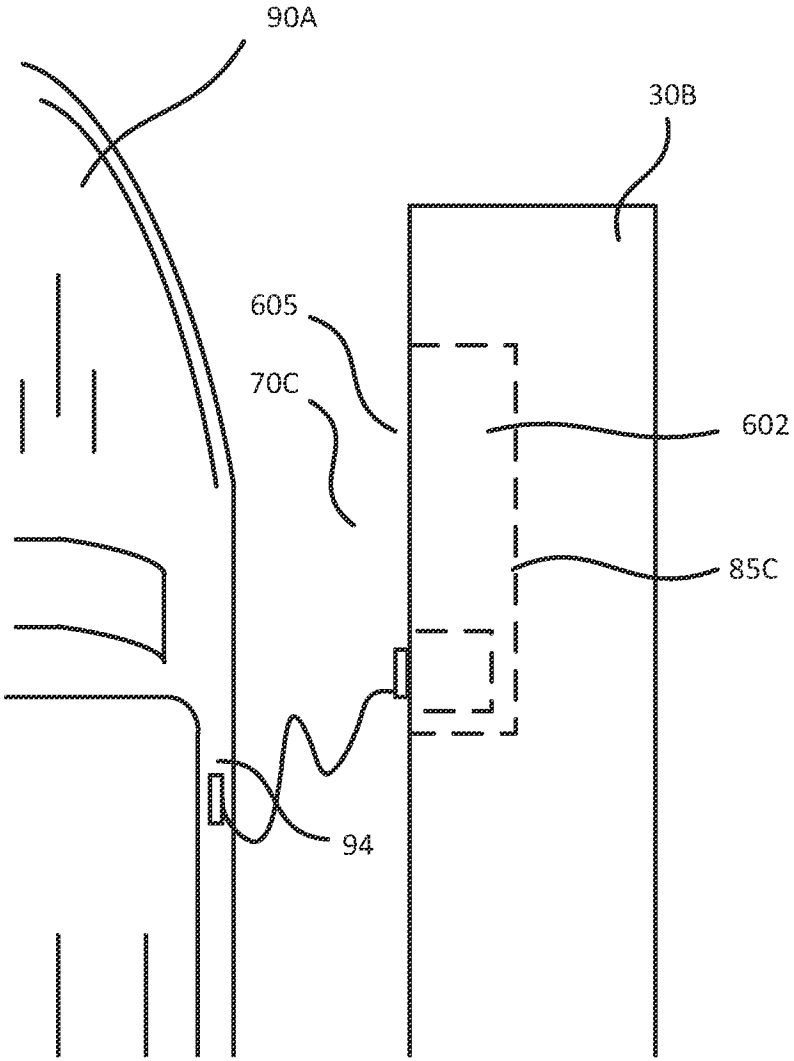
FIG. 22 schematically illustrates the line tensioning unit of FIG. 1 in a retracted state in side view, with a slackened line connecting a cleat of the line tensioning unit to a cleat upon a neighboring boat, in accordance with the present disclosure.

FIG. 22 schematically illustrates the line tensioning unit 85C of FIG. 1 attached to the dock section 30B in a retracted state in side view, with a slackened line 70C connecting the cleat 605 of the line tensioning unit 85C to a cleat 94 upon the boat 90A. The cleat carrier device 602 is positioned at a side of the line tensioning device 85C relatively closer to the cleat 94, thereby reducing a distance between the cleat 94 and the cleat 605. As a result, the line 70C is slackened, thereby permitting one to easily attach the line 70C to each of the cleats 94, 605. Further, by ordering which of the lines 70A, 70B, 70C of FIG. 1 are made taught first, the position of boat 90A may be set.

Figure 23:
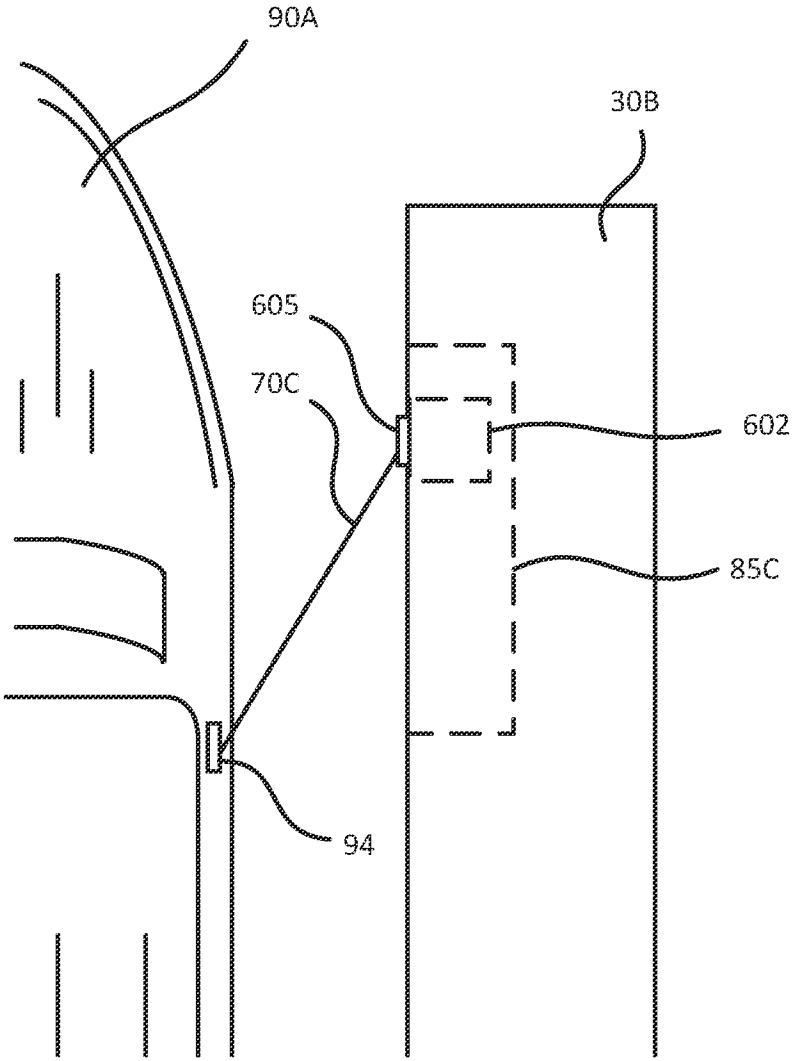
FIG. 23 schematically illustrates the line tensioning unit of FIG. 22 in an extended state, with the line connecting the cleats in a taught condition, in accordance with the present disclosure.

FIG. 23 schematically illustrates the line tensioning unit 85C of FIG. 22 attached to the dock section 30B in an extended state, with the line 72C connecting the cleats 94, 605 in a taught condition. The line tensioning unit 85C including the cleat carrier device 802 and the cleat 805 is illustrated in the extended state, with the cleat carrier device 802 and the cleat 805 is relatively distal from the cleat 94.

Figure 24:
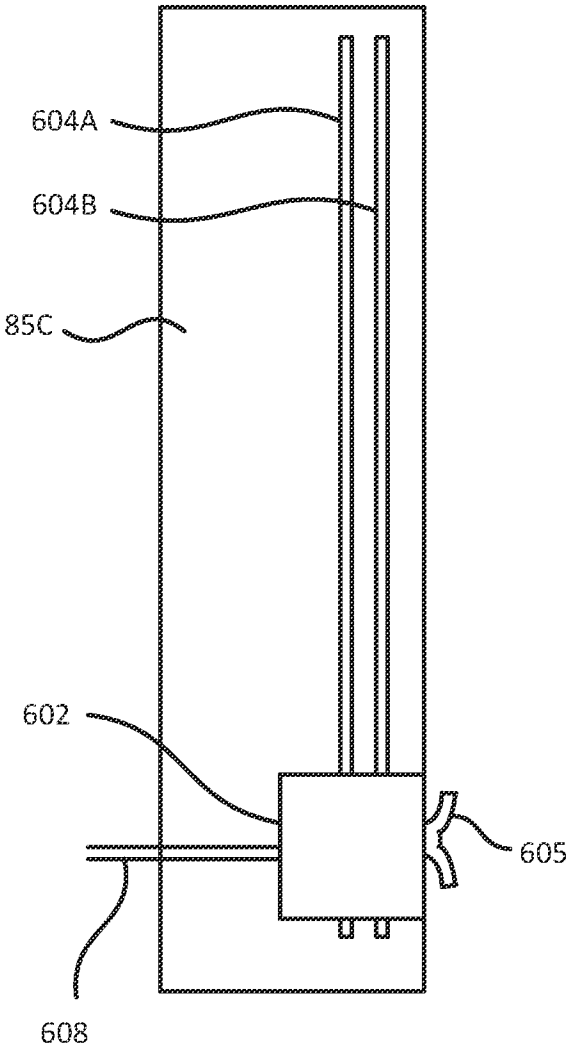
FIG. 24 schematically illustrates the line tensioning unit of FIG. 22 in a bottom up view, in accordance with the present disclosure.

FIG. 24 schematically illustrates the line tensioning unit 85C of FIG. 22 in a bottom up view. The line tensioning unit 85C is illustrated including the cleat carrier device 602, the cleat 605, and cleat rails 604A, 604B. The cleat carrier device 602 is configured to move along the length of the cleat rails 604A, 604B as required to transition the line transitioning unit 85C between the retracted and extended states. A wire harness 608 is illustrated providing power and/or data to the cleat carrier device 602. The cleat carrier device 602 may include a computerized or electronic controller useful to operate programming to control movement of the cleat carrier device 602, for example, by monitoring commands entered by a user. In another embodiment, the cleat carrier device 602 may simply receive commands or move based upon electrical power supplied through the wire harness 608.

Figure 25:
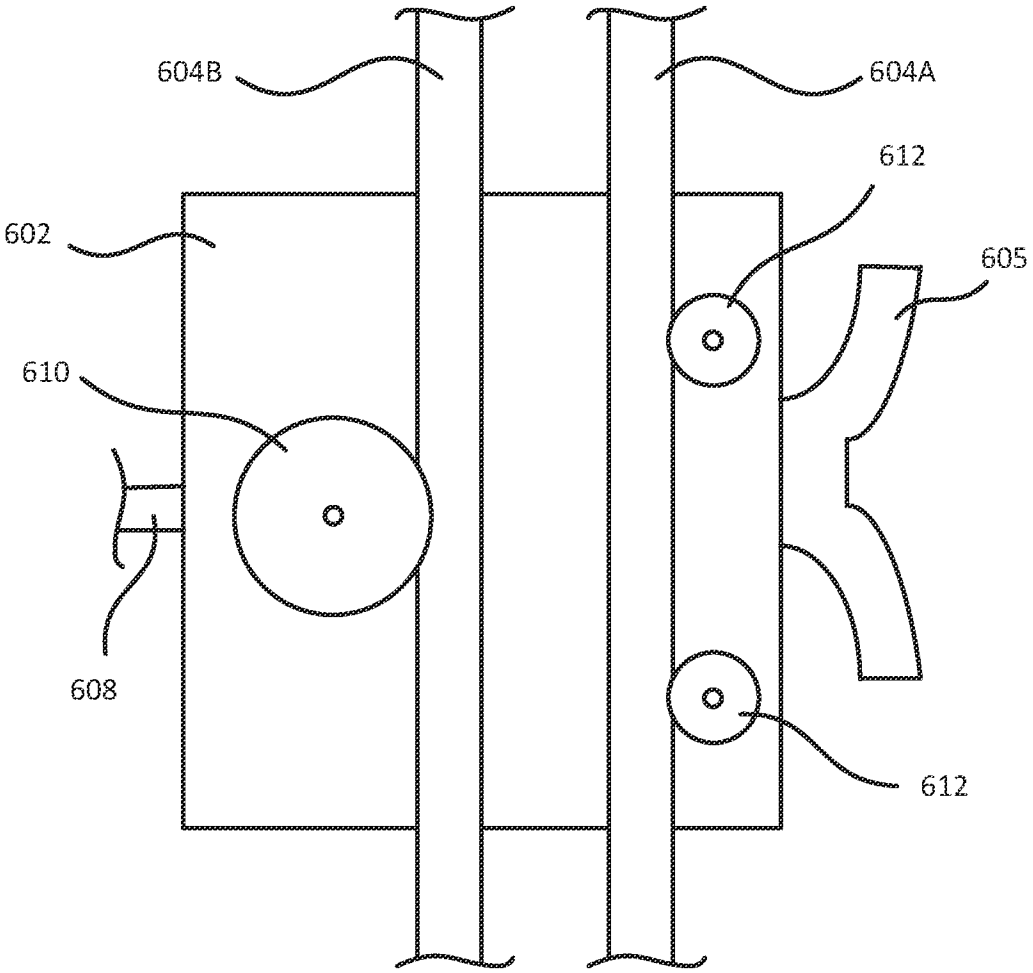
FIG. 25 schematically illustrates a clear carrier device of the line tensioning unit of FIG. 24 in top down view, in accordance with the present disclosure.

FIG. 25 schematically illustrates a clear carrier device of the line tensioning unit of FIG. 24 in top down view. The cleat carrier device 602 is illustrated including the cleat 605 and may include an electric motor therewithin. A drive wheel 610 and two free-wheeling bracket wheels 612 are illustrated connecting the cleat carrier device 602 to the cleat rails 604A, 604B. The drive wheel 610 receives torque from the electrical motor of the cleat carrier device 602 and turns, with the drive wheel 610 turning against the cleat rail 604B to provide motive force to the cleat carrier device 602. In one embodiment, the drive wheel 610 and the cleat rail 604B may include smooth surfaces, and the motive force is provided by friction between the drive wheel 610 and the cleat rail 604B. In another embodiment, the drive wheel 610 and the cleat rail 604B may include interlocking teeth or notches similar to an automotive timing belt. The drive wheel 610 and the cleat rail 604B may overlap each other, and the bracket wheels 612 and the cleat rail 604A may overlap each other, such that the cleat carried device 602 is held proximate to the cleat rails 604A, 604B by the wheels 610, 612. Wire harness 608 is additionally illustrated.

The line tensioning unit 85C, the cleat carrier device 602, and the rails 604A, 604B are exemplary. A number of alternative configurations of the line tensioning unit 85C are envisioned. The cleat carrier device 602 may be belt driven, with a stationary motor driving the belt to move the cleat carrier device 602. A hydraulic or pneumatic actuator may be utilized to move the cleat carrier device 602. The disclosure is not intended to be limited to the examples provided herein.

Figure 26:
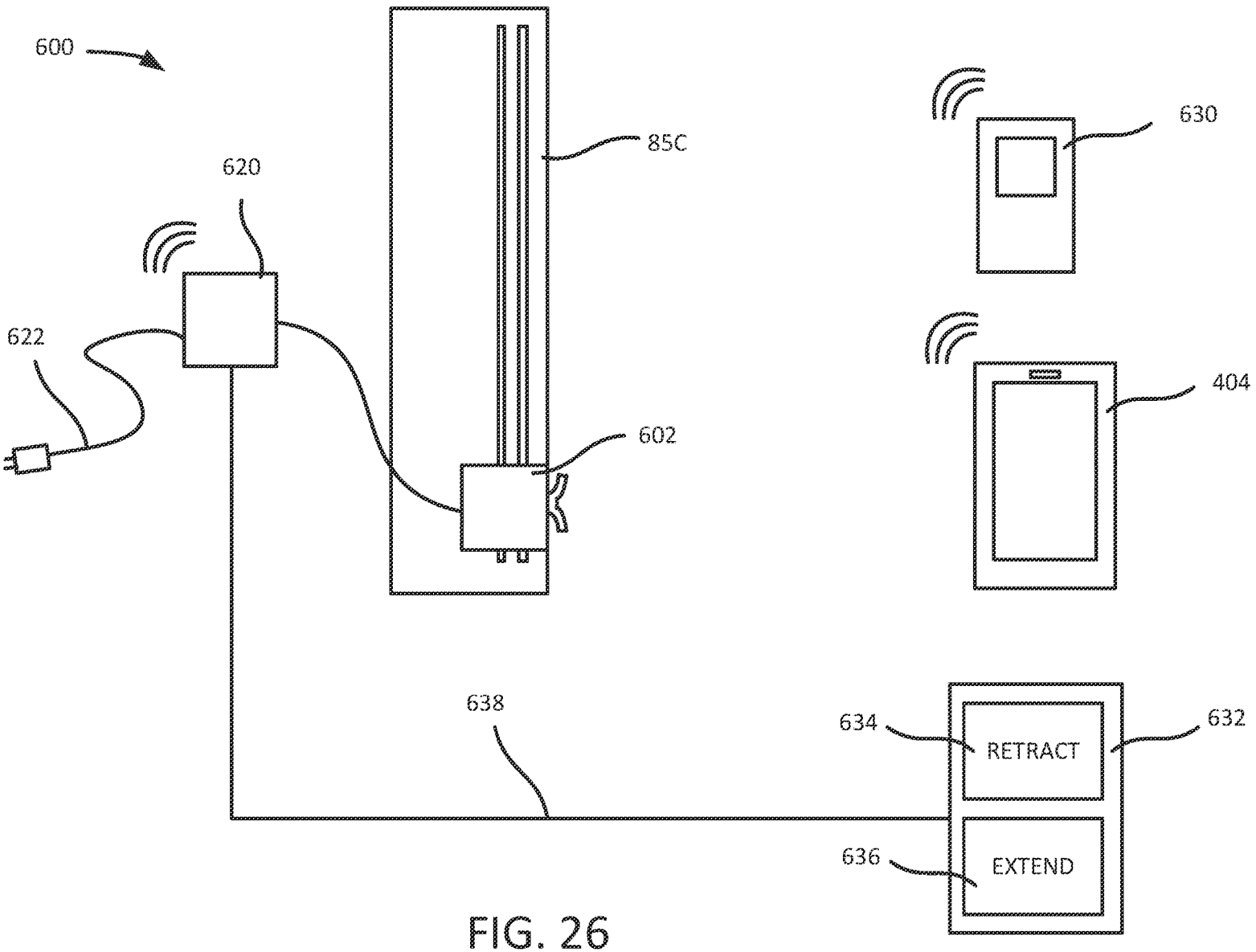
FIG. 26 schematically illustrates an exemplary system for providing a translating cleat to automatically provide a taught line useful to moor a boat, including a line tensioning unit and a plurality of control devices, in accordance with the present disclosure.

FIG. 26 schematically illustrates an exemplary system 600 for automatically providing a taught line useful to moor a boat, including a line tensioning unit 85C and a plurality of control devices 630, 404, 632. In some embodiments, the cleat carrier device 602 may include a computerized or electronic controller internal thereto to control movement of the cleat carrier device 602. In the embodiment of FIG. 26, an external controller 620 is illustrated including an alternating current power cord 622. The controller 620 receives commands from one or more of the control devices 630, 404, 632 and controls operation of the cleat carrier device 602. The controller 620 may send electrical power and/or data commands to the cleat carrier device 602.

The control device 630 is illustrated embodied as a push button radio frequency controller similar to a garage door opener device in the art. Upon a button or switch upon the control device 630 being activated, a circuit board within the control device 630 may generate a radio frequency signal which may be received by the controller 620. Each push of the button upon the control device 630 may result in the controller 620 reversing a command between the line tensioning unit 85C being alternatively in a retracted state or an extended state. A first push of the button may result in the line tensioning unit 85C being commanded to transition to a retracted state. A subsequent second push of the button may result in the line tensioning unit 85 being commanded to transition to an extended state.

The control device 404 is illustrated embodied as the cellular device. The cellular device may include an operating system enabling operation of software applications upon the cellular device. The cellular device may command movement of the cleat carrier device 602. The cellular device may command operation of the line tensioning unit 85C between the retracted and extended states. The cellular device may command movement of the clear carrier device 602 until a required line tension force or corresponding current draw is monitored. The cellular device may command a complex operation spanning a plurality of line tensioning units 85A, 85B, 85C of FIG. 1, with the line tensioning units 85A, 85B, 85C accomplishing precise placement and orientation of the boat or iteratively tensioning the lines 70A, 70B, 70C to achieve a desired mooring result.

The control unit 632 includes an infrastructure control device, for example, including a wire harness 638 directly connecting the control unit 632 to the controller 620. The control unit 632 may be located for a dock worker or a harbor master to command operation of the line tensioning unit 85C.

Figure 27:
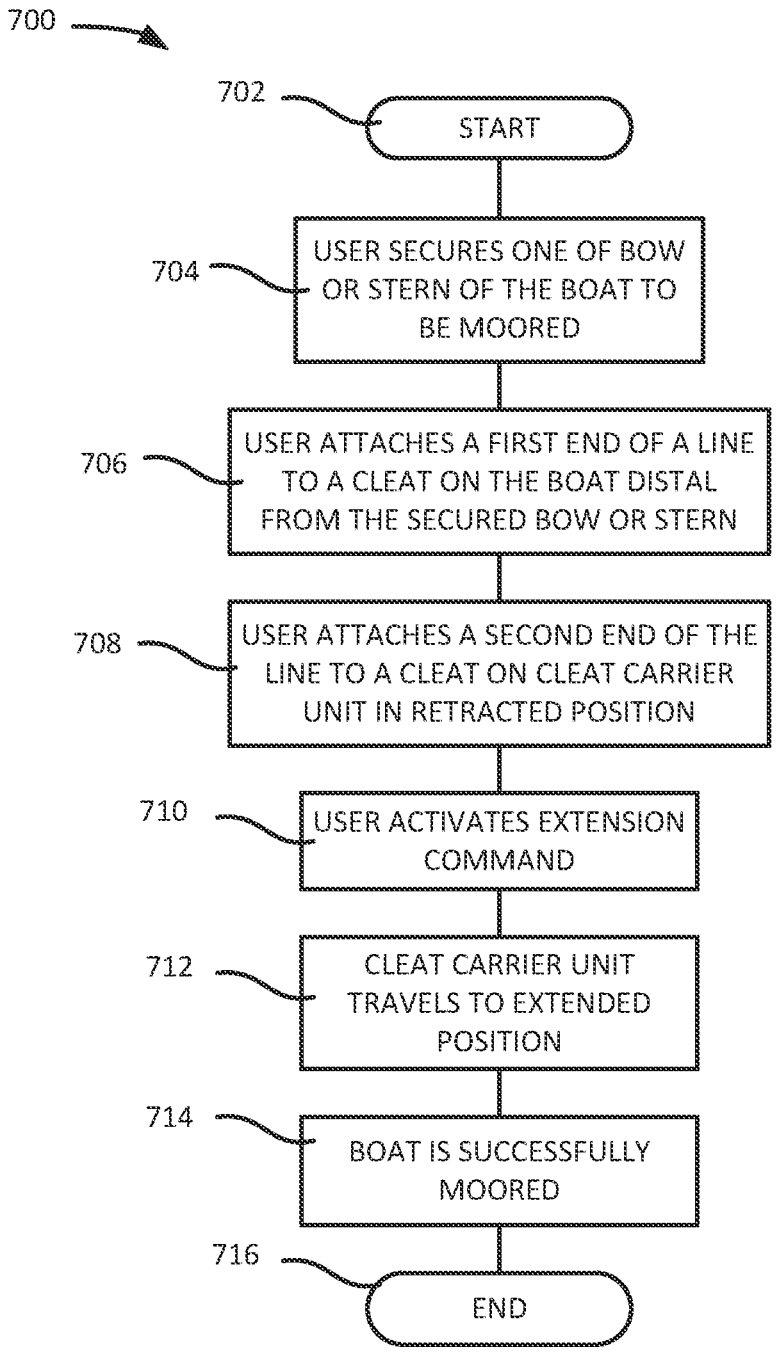
FIG. 27 is a flowchart illustrating an exemplary method to utilize a system for providing a translating cleat to moor a boat, in accordance with the present disclosure.

FIG. 27 is a flowchart illustrating an exemplary method 700 to utilize a system 600 for providing a translating cleat 605 to moor a boat 90A. The method 700 is described in relation to the boat 90A of FIG. 1 and the system 600 of FIG. 26, although it will be appreciated that the disclosed method 700 may be operated with alternative configurations and equipment. The method 700 starts at step 702. At step 704, the user secures the bow or the stern of the boat 90A to be moored. In one example, the user may manually lash lines 70A, 70B to corresponding cleats. In another example, the user may command operation of line tensioning units 85A, 85B. At step 706, the user attached a first end of the line 70C to the cleat 94 upon the boat 90A, wherein the cleat 94 is located upon the boat 90A relatively distal from the secured bow or stern. By securing the line 70C to the cleat 94 relatively distal from the secured bow or stern of the boat 90A, the position and the orientation of the boat 90A may be securely fixed by securing to a plurality of points dispersed about the center of mass of the boat 90A. At step 708, with the line tensioning unit 85C in the retracted state, the user attaches a second end of the line 70C to the cleat 605 upon the cleat carrier device 602. At step 710, the user activates a command to transition the line tensioning unit 85C into the extended state. At step 712, the line tensioning unit 85C commands or moves the cleat carrier device 602 to the position associated with the line tensioning unit 85C being in the extended state. At step 712, the boat is successfully moored. At step 714, the method 700 ends. The method 700 is provided as an exemplary method to utilize the disclosed line tensioning unit 85C to make a line 70C attached to the boat 90A taught and thereby accomplishing mooring the boat 90A. A number of additional and/or alternative steps are envisioned, and the disclosure is not intended to be limited to the examples provided herein.

Figure 28:
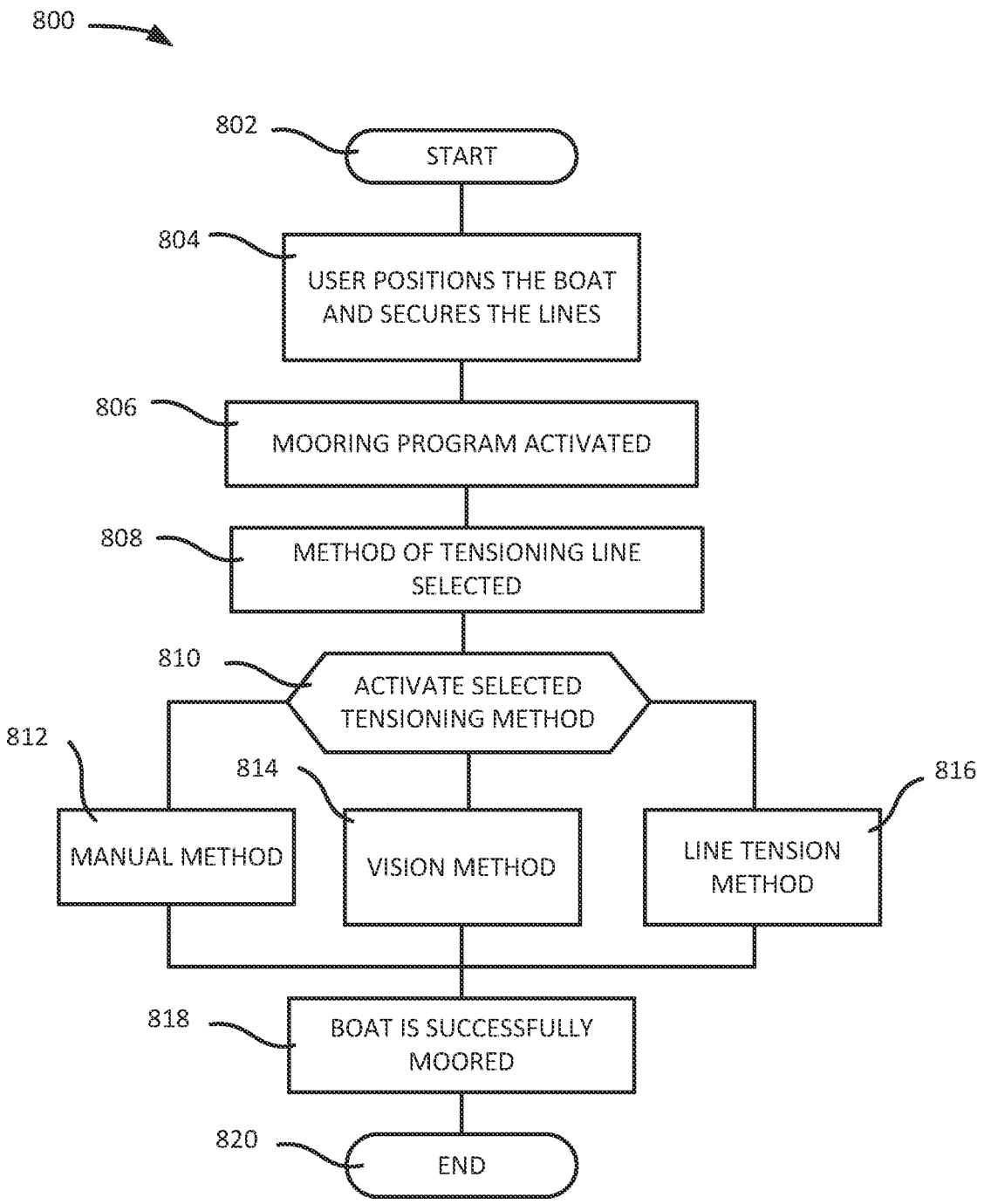
FIG. 28 is a flowchart illustrating an exemplary method to tension a line with the line tensioning unit of FIG. 1, in accordance with the present disclosure.

FIG. 28 is a flowchart illustrating an exemplary method 800 to tension line 70C with the line tensioning unit 85C of FIG. 1. The method 800 is described in relation to the boat 90A of FIG. 1 and the system 600 of FIG. 26, although it will be appreciated that the disclosed method 800 may be operated with alternative configurations and equipment. The method 800 starts at step 802. At the step 804, the user positions the boat and secures associated lines 70A, 70B, 70C to respective cleats. At step 806, a mooring program is activated. At step 808, a process for tensioning one or more of the lines is selected. If an exemplary manual process, requiring the user to manually cycle or move the cleat 605 by activation of a control device 630, 404, 632, is selected, the method 800 advances to step 812 wherein manual inputs by a user set a desired tension in the associated line(s). If an exemplary vision process, requiring an optical sensor to determine linearity of the associated line(s), is selected, the method 800 advances to step 814 wherein a visual sensor provides data to controller 620 to adjust tension in the line. If an exemplary line tension process, requiring the controller 620 to monitor a current drawn by the electric motor of the associated cleat carrier device 602 to determine how much tension is being created in the line 70C, is selected, the method 800 advances to step 816 wherein a current drawn may be compared to a threshold current calibrated to create a desired line tension, and the comparison is used to control the electric motor of the cleat carrier device 602. At step 818, the boat is successfully moored. In some embodiment, for example, wherein the lines 70A, 70B, 70C are configured to provide repeatable lashings to the respective cleats, the results of the process selected in the step 810 may be saved for a particular boat 90A and reused. At step 820, the method 800 ends. The method 800 is provided as an exemplary method to utilize the disclosed line tensioning unit 85C to make a line 70C attached to the boat 90A taught and thereby accomplishing mooring the boat 90A. A number of additional and/or alternative steps are envisioned, and the disclosure is not intended to be limited to the examples provided herein.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention claimed is:

1. A system for providing a line to a boat, comprising:
the line attached to a portion of a dock;
a line tending unit configured for selectively operating in a stowed state and in a deployed state, wherein the line tending unit includes:
a line tending arm including an attachment end configured for releasably holding the line; and
a line tending unit actuator configured to actuate the line tending arm between a stowed condition corresponding to the stowed state and a deployed condition corresponding to the deployed condition;
a control device in communication with the line tending unit and configured for commanding the line tending unit between the stowed state and the deployed state; and
the dock including a bollard; and
wherein the line tending unit is attached to the bollard;
wherein the line tending unit, when in the stowed state, further includes the line tending arm in a parallel condition to a longitudinal axis of the bollard; and
wherein the line tending unit, when in the deployed state, further includes the line tending arm forming an oblique angle relative to the longitudinal axis of the bollard.

2. The system of claim 1, wherein the line tending unit operating in the deployed state further includes extending the line tending arm outwardly over a surface of a body of water.

3. A system for providing a line to a boat, comprising:
the line attached to a portion of a dock;
a line tending unit configured for selectively operating in a stowed state and in a deployed state, wherein the line tending unit includes:
a line tending arm including an attachment end configured for releasably holding the line; and
a line tending unit actuator configured to actuate the line tending arm between a stowed condition corresponding to the stowed state and a deployed condition corresponding to the deployed condition;
a control device in communication with the line tending unit and configured for commanding the line tending unit between the stowed state and the deployed state; and
the dock including:
a horizontal surface; and
a vertical surface adjacent to and below the horizontal surface; and
wherein the line tending unit is attached to the vertical surface; and
wherein the line tending unit, when in the stowed state, further includes the line tending arm in a horizontal orientation parallel to the vertical surface.

4. A system for providing a line to a boat, comprising:
the line attached to a portion of a dock;
a line tending unit configured for selectively operating in a stowed state and in a deployed state, wherein the line tending unit includes:
a line tending arm including an attachment end configured for releasably holding the line; and
a line tending unit actuator configured to actuate the line tending arm between a stowed condition corresponding to the stowed state and a deployed condition corresponding to the deployed condition; and a control device in communication with the line tending unit and configured for commanding the line tending unit between the stowed state and the deployed state; and wherein the line tending unit actuator includes:

a battery;

an electric motor;

a wireless communications device configured for receiving a command from the control device; and a computerized or electronic controller in communication with the wireless communication device and configured for controlling the electric motor based upon the command.

5. The system of claim 4, wherein the control device includes a push-button device configured for transmitting a radio frequency signal including the command to the line tending unit actuator.

6. The system of claim 4, wherein the control device includes a cellular device configured for providing the command to the line tending unit actuator.

7. The system of claim 1, wherein the control device includes a wire harness connecting the control device to the line tending unit actuator.

8. A system for providing a line to a boat, comprising:

the line attached to a portion of a dock;

a line tending unit configured for selectively operating in a stowed state and in a deployed state, wherein the line tending unit includes:

a line tending arm including an attachment end configured for releasably holding the line; and a line tending unit actuator configured to actuate the line tending arm between a stowed condition corresponding to the stowed state and a deployed condition corresponding to the deployed condition; and a control device in communication with the line tending unit and configured for commanding the line tending unit between the stowed state and the deployed state; and wherein the line tending arm includes a counterweight.

9. A system for providing a line to a boat, comprising:

the line attached to a portion of a dock;

a line tending unit configured for selectively operating in a stowed state and in a deployed state, wherein the line tending unit includes:

a line tending arm including an attachment end configured for releasably holding the line; and a line tending unit actuator configured to actuate the line tending arm between a stowed condition corresponding to the stowed state and a deployed condition corresponding to the deployed condition;

a control device in communication with the line tending unit and configured for commanding the line tending unit between the stowed state and the deployed state; and a solar panel configured for providing electrical energy to the line tending unit actuator.

10. The system of claim 1, further comprising a replaceable, rechargeable battery pack configured for selective attachment to the line tending unit actuator and for providing electrical energy to the line tending unit actuator.

11. A system for providing a line to a boat, comprising:

the line attached to a portion of a dock, wherein the line includes a first line;

a line tending unit configured for selectively operating in a stowed state and in a deployed state, wherein the line tending unit includes:

a line tending arm including an attachment end configured for releasably holding the line; and a line tending unit actuator configured to actuate the line tending arm between a stowed condition corresponding to the stowed state and a deployed condition corresponding to the deployed condition;

a control device in communication with the line tending unit and configured for commanding the line tending unit between the stowed state and the deployed state;

the boat;

a second line; and the dock including:

a boat slip configured for receiving the boat; and a line tensioning unit configured for, when the second line is attached to the boat, selectively providing tension to the second line.

12. The system of claim 11, wherein the line tensioning unit includes:

a cleat rail; and a cleat carrier device including a cleat and configured for moving along the cleat rail.

13. A system for providing a line to a boat, comprising:

a dock including a bollard;

the line attached to a portion of the dock;

a line tending unit attached to the bollard and configured for selectively operating in a stowed state and in a deployed state, wherein the line tending unit includes:

a line tending arm including an attachment end configured for releasably holding the line; and a line tending unit actuator configured to actuate the line tending arm between a stowed condition corresponding to the stowed state and a deployed condition corresponding to the deployed condition, wherein the line tending unit actuator includes:

an electric motor;

a wireless communications device configured for receiving a command from a control device; and a computerized or electronic controller in communication with the wireless communication device and configured for controlling the electric motor based upon the command; and the control device in communication with the line tending unit and configured for commanding the line tending unit between the stowed state and the deployed state.

14. The system of claim 13, wherein the line includes a first line; further comprising:

the boat; and a second line; and wherein the dock further includes:

a boat slip configured for receiving the boat; and a line tensioning unit configured for, when the second line is attached to the boat, selectively providing tension to the second line.

15. A device for providing a line to a boat, the device comprising:

a line tending unit configured for selectively operating in a stowed state and in a deployed state, wherein the line tending unit includes:

a line tending arm including an attachment end configured for releasably holding the line; and a line tending unit actuator configured to actuate the line tending arm between a stowed condition corresponding to the stowed state and a deployed condition corresponding to the deployed condition; and wherein the line tending unit actuator includes:

an electric motor;

a wireless communications device configured for receiving a command from a control device; and a computerized or electronic controller in communication with the wireless communication device and configured for controlling the electric motor based upon the command.

* * * * *